US005609034A

United States Patent [19]

Mita et al.

[11] Patent Number: 5,609,034

[45] Date of Patent: Mar. 11, 1997

[54] COOLING SYSTEM

[75] Inventors: Hideo Mita, Okazaki; Hideo Misawa; Naoto Kurita, both of Anjo; Katsunobu Kanda, Toyohashi, all of Japan

[73] Assignee: Aisin Seiki Kabushiki Kaisha, Kariya, Japan

[21] Appl. No.: 501,938

[22] Filed: Jul. 13, 1995

[30] Foreign Application Priority Data

Jul. 14, 1994 [JP] Japan ..... 6-162310
Oct. 31, 1994 [JP] Japan ..... 6-267304

[51] Int. Cl.[6] ..... F25B 9/00
[52] U.S. Cl. ..... 62/6; 60/520
[58] Field of Search ..... 62/6; 60/520

[56] References Cited

U.S. PATENT DOCUMENTS 4,845,953 7/1989 Misawa et al. ..... 62/6
5,088,289 2/1992 Mita et al. ..... 62/6
5,101,635 4/1992 Mita et al. ..... 62/6
5,152,147 10/1992 Saho et al. ..... 62/6
5,335,506 8/1994 Byoung-Moo ..... 62/6

FOREIGN PATENT DOCUMENTS 45-27634 9/1970 Japan .

*Primary Examiner*—Ronald C. Capossela
*Attorney, Agent, or Firm*—Oblon, Spivak, McClelland, Maier & Neustadt, P.C.

[57] ABSTRACT

A cooling system includes a cold-accumulating refrigerator, and a cooling circuit. The cold-accumulating refrigerator includes a cold accumulator. The cooling circuit includes a heat exchanger. The heat exchanger is thermally brought into contact with a portion of the cold accumulator whose temperature is varied from a high temperature to a low temperature by a working medium flowing therein. Thus, it is possible to utilize cold produced by the working medium flowing in the cold accumulator in one cycle (e.g., from a high temperature to a low temperature, and from a low temperature to a high temperature), thereby remarkably enhancing the cooling system in terms of cooling efficiency.

17 Claims, 18 Drawing Sheets

(A)

(B)

( PRIOR ART )

COOLING SYSTEM

BACKGROUND OF THE INVENTION

1. Field of the Invention

The present invention relates to a cooling system for cooling a substance to be cooled by producing cold with a cold-accumulating refrigerator.

2. Description of Related Art

Japanese Examined Patent Publication (KOKOKU) No. 45-27,634 discloses a conventional cooling system which employs a cold-accumulating refrigerator, and which is constructed as illustrated in FIG. 21. As illustrated in FIG. 21, this conventional cooling system comprises a cold gas refrigerator 101 which operates as a cold source under reverse Stirling cycle, and a cooling circuit 120 which operates as a refrigerant circuit for delivering cold to a substance 110 to be cooled.

The cold gas refrigerator (hereinafter simply referred to as "refrigerator") 101 includes a cylinder 100, a piston 102 which reciprocates in the cylinder 100, a displacer 103 which reciprocates with a predetermined phase difference with respect to the piston 102, a chiller 106 which communicates with a compression chamber 104 disposed between the piston 102 and the displacer 103, a freezer 108 which is disposed in an expansion chamber 105 placed between the displacer 103 and a top end of the cylinder 101, and a cold accumulator 107 which is disposed between the chiller 106 and the expansion chamber 105.

The cooling circuit 120 includes a compressor 121, a piping 124, and a counterflow heat exchanger 123 which is disposed between the piping 12 and the compressor 121. The piping 124 includes a plurality of heat exchangers 125 for conducting cold, and a plurality of heat exchangers 126 for cooling a substance 110 to be cooled. The heat exchangers 125 are thermally brought into contact with the freezer 108. The heat exchangers 125 and the heat exchangers 126 are disposed alternately in series.

In the thus constructed conventional cooling system, the piston 102 compresses a working medium to produce heat in the compression chamber 104 of the refrigerator 101 (i.e., isothermal compression). Then, the displacer 103 moves toward the piston 102 to cool and pass the working medium through the cold accumulator 107 (i.e., constant-volume cooling). Further, the piston 102 retracts to produce cold in the expansion chamber 105 (i.e., isothermal expansion), and the cold is absorbed by the other working medium which flows in the cold-conducting heat exchanger 125 being thermally brought into contact with the freezer 108. Furthermore, the displacer 103 moves to its top dead center, and thereby the working medium cools the cold accumulator 107 and returns to the compression chamber 104 (i.e., constant-volume heating).

The other working medium flows in the cooling circuit 120. When it flows in the cold-conducting heat exchanger 125, its heat is absorbed, and cold thus produced is conducted to the heat exchanger 126 for cooling. Accordingly, the substance 110 to be cooled is cooled. The counterflow heat exchanger 123 cools the high-temperature working medium, which is delivered from the compressor 121, by means of the low-temperature working medium which returns to the compressor 121.

The thus constructed cooling system can employ a helium gas as the working media, and can be applied to home-use refrigerators, air conditioners, etc. When its refrigerator employs a multi-staged expansion arrangement, and when its cooling circuit utilizes a Joule-Thomson (hereinafter referred to as "J-T") circuit, it is possible to attain a liquefied helium temperature as low as 4.2 K., and to cool superconducting magnets.

According to the equation defining the Carnot efficiency, the lower the temperature of the cold source is, the worse the efficiency is for cooling a substance to be cooled. When the conventional cooling system is considered in terms of efficiency from this perspective, it takes out cold produced at the expansion chamber 105, and gives the cold to the freezer 108. The cold-conducting heat exchangers 125 receive the cold, and transfer it to the heat exchangers 126 for cooling. Then, the substance 110 to be cooled is cooled. Thus, the conventional cooling system does not utilize the cold produced by the entire refrigerator 101 effectively.

Specifically, the refrigeration Q taken out to the freezer 108 is used to cancel the refrigeration $Q_1$ consumed to cool the substance 110 to be cooled, the refrigeration $Q_2$ consumed at the counterflow heat exchanger 123, and the heat $Q_3$ (i.e., conduction heat and radiation heat) intruding into the counterflow heat exchanger 123 from the surroundings; namely: the refrigeration Q equals $Q_1+Q_2+Q_3$ (i.e., $Q_1=Q_1+Q_2+Q_3$). Let us assume that the freezer 108 is a cold source of a predetermined temperature which corresponds to the cold head of refrigerator 101. The cold is produced from the predetermined temperature which shows a specific temperature difference with respect to the temperature of the substance 110 to be cooled, it is not produced from a high temperature which is higher than the predetermined temperature. In other words, in a temperature range of from the temperature of the refrigerator cold head to the temperature of the highly-pressurized working medium itself delivered from the compressor 121, the refrigerations $Q_2$ and $Q_3$ are consumed to cool the highly-pressurized working medium, being delivered from the compressor 121, by means of the counterflow heat exchanger 123. As a result, the cold is not produced from the high temperature which is higher than the predetermined temperature and which enables to efficiently carry out cooling.

SUMMARY OF THE INVENTION

It is therefore an object of the present invention to provide a cooling system which can take out cold, produced by a refrigerator, not only from a predetermined temperature, but also in a temperature range from a high temperature to a low temperature so as to effectively utilize cold produced by a refrigerator, and whose cooling efficiency is remarkably improved accordingly.

A first aspect of the present invention is characterized in that a portion of a cold accumulator, whose temperature is varied from a high temperature to a low temperature by a working medium flowing in a cold-accumulating refrigerator, is thermally brought into contact with a heat exchanger of a cooling circuit, which cools a substance to be cooled by the other working medium.

In the first aspect of the present invention, a portion of a cold accumulator, whose temperature is varied from a high temperature to a low temperature by a working medium flowing in a cold-accumulating refrigerator, is brought into contact with a heat exchanger of a cooling circuit. This arrangement results in utilizing cold, which is produced by the working medium flowing in the cold accumulator in one cycle (e.g., from a high temperature to a low temperature, and from a low temperature to a high temperature), to cool a substance to be cooled.

To put it differently, when the working medium flows from a high-temperature side to a low-temperature side, it exhibits a temperature $T_1$ in a cross-section crossing perpendicularly with the flow. The temperature $T_1$ is higher than that of a cold-accumulating member, because a cold accumulator does not exhibit 100% heat-exchanging efficiency. When the working medium flows from a low-temperature side to a high-temperature side, it exhibits a temperature $T_2$ in a cross-section crossing perpendicularly with the flow. The temperature $T_2$ is lower than that of the cold-accumulating member. Let us assume that an average temperature of the cold-accumulating member is T, there are established the following inequalities:

$$T_1-T>0; \text{ and}$$

$$T_2-T<0.$$

Accordingly, in the refrigerator, there is established the following inequality:

$$T_1-T<T_2-T.$$

Hence, the working medium flowing in the cold-accumulator exhibits a cooling capability, and produces cold in a cross-section crossing perpendicularly with the flow of the working medium in one cycle (e.g., from a high temperature to a low temperature, and from a low temperature to a high temperature).

In other words, in the first aspect of the present invention, the working medium reciprocating in the cold accumulator gives the cold accumulator a cooling capability. Thus, it is possible to sharply enhance the cooling efficiency by obtaining cold from the cold accumulator which operates as a virtual expansion cylinder.

Moreover, considering the above-described cooling principle of the first aspect of the present invention from the perspective of the Carnot efficiency, to thermally bring into a cold-conducting heat exchanger with a portion of a cold accumulator, whose temperature is varied from a high temperature to a low temperature, results in obtaining cold from a high-temperature cold source. Thus, the thermal contact gives cooling efficiency more effectively than cooling produced by a specific-temperature cold source. As a result, an overall refrigeration is larger than those obtaining cold only from a specific-temperature cold source. Hence, cooling efficiency can be enhanced.

In accordance with the first aspect of the present invention, a portion of the cold accumulator, whose temperature is varied from a high temperature to a low temperature, is thermally brought into contact with the cold-conducting heat exchanger of the cooling circuit for cooling a substance to be cooled. Thus, it is possible to utilize cold, which is produced by the working medium flowing in the cold accumulator in one cycle (e.g., from a high temperature to a low temperature, and from a low temperature to a high temperature). Therefore, the substance to be cooled can be cooled with enhanced cooling efficiency.

A second aspect of the present invention is characterized in that two or more cold-conducting heat exchangers are disposed in a cooling circuit, a first cold-conducting heat exchanger is thermally brought into contact with a portion of a cold accumulator whose temperature is varied from a high temperature to a low temperature by a working medium flowing in a cold-accumulating refrigerator, and a second cold-conducting heat exchanger is thermally brought into contact with an expansion chamber of the cold-accumulating refrigerator or a low-temperature end of the cold accumulator.

In the second aspect of the present invention, a first cold-conducting heat exchanger is brought into contact with a portion of a cold accumulator whose temperature is varied from a high temperature to a low temperature. The first cold-conducting heat exchanger corresponds to the cold-conducting heat exchanger of the first aspect of the present invention. In addition, a second cold-conducting heat exchanger is thermally brought into contact with an expansion chamber of a refrigerator or a low-temperature end of the cold accumulator. Thus, it is apparent that, in terms of cooling efficiency, the second aspect of the present invention can be improved over the first aspect of the present invention.

In accordance with the second aspect of the present invention, a synergetic advantageous effect can be produced by the cold-conducting heat exchanger according to the first aspect of the present invention, and by the cold-conducting heat exchanger which is thermally brought into contact with the expansion chamber of the refrigerator or the cold accumulator at the low-temperature end. Hence, the cooling efficiency can be further enlarged.

A third aspect of the present invention is characterized in that the cold-conducting heat exchanger is disposed in the cold accumulator.

In the third aspect of the present invention, a cold-conducting heat exchanger is disposed in a cold accumulator. Consequently, cold can be obtained from the cold accumulator efficiently, and the cooling efficiency can be further enhanced.

In accordance with the third aspect of the present invention, the cold-conducting heat exchanger is disposed in the cold accumulator. Therefore, it is possible for the cold-conducting heat exchanger to obtain cold from the cold accumulator efficiently. Thus, the third aspect of the present invention provides an effective method to improve the cooling efficiency.

A fourth aspect of the present invention is characterized in that the expansion chamber includes a peripheral wall defining a cylinder outer periphery, and the cold-conducting heat exchanger and the cold accumulator are disposed coaxially with the cylinder outer periphery.

In the fourth aspect of the present invention, without impairing the high cooling efficiency produced by the first aspect of the present invention, a cold-conducting heat exchanger and a cold accumulator can be integrated in an expansion cylinder.

In accordance with the fourth aspect of the present invention, the high cooling efficiency produced by the first aspect of the present invention can be maintained, and simultaneously the cold-conducting heat exchanger and the cold accumulator can be integrated so as to downsize an entire cooling system.

A fifth aspect of the present invention is characterized in that a cooling circuit includes a counterflow heat exchanger, a high-pressure-side circuit disposed in the counterflow heat exchanger, a low-pressure-side circuit disposed in the counterflow heat exchanger, and pressure delivering means for delivering a refrigerant from the high-pressure-side circuit to the low-pressure-side circuit in the cooling circuit, and that a portion of a cold accumulator of a cold-accumulating refrigerator, whose temperature is varied from a high temperature to a low temperature by the other refrigerant flowing therein, is thermally brought into contact with at least one of the high-pressure-side circuit and the low-pressure-side circuit of the cooling circuit.

In the fifth aspect of the present invention, a high-pressure-side circuit disposed in a counterflow heat exchanger can be thermally brought into contact with a cold accumulator. If such is the case, a refrigerant flowing in the high-pressure-side circuit disposed in the counterflow heat exchanger can be cooled by two refrigerants (e.g., the other refrigerant flowing in the cold accumulator of the cold-accumulating refrigerator, and the refrigerant itself flowing in a low-pressure-side circuit which connects cooling means and an inlet port of pressure delivering means). As described in the first aspect of the present invention, the other refrigerant flowing in the cold accumulator of the cold-accumulating refrigerator carries out the cooling so as to cool the refrigerant in a temperature range of from a high temperature to a low temperature along the flow of the other refrigerant in the cold accumulator. Likewise, considering this cooling from the perspective of the Carnot efficiency, it is carried out more efficiently than to cool the refrigerant by specific low-temperature cold which is produced in the expansion chamber of the cold-accumulating refrigerator. In addition, the refrigerant flowing in the high-pressure-side circuit is also cooled by the refrigerant flowing in the low-pressure-side circuit. As a result, it is possible to enlarge the refrigeration which is used to cool a substance to be cooled via the cooling means, and to remarkably improve a cooling system in terms of cooling efficiency.

Moreover, in the fifth aspect of the present invention, a low-pressure-side circuit disposed in a counterflow heat exchanger can be thermally brought into contact with a cold accumulator. If such is the case, a refrigerant flowing in the high-pressure-side circuit disposed in the counterflow heat exchanger can be cooled by the refrigerant flowing in the low-pressure-side circuit disposed in the counterflow heat exchanger, and the refrigerant flowing in the low-pressure-side circuit can receive cold from the other refrigerant flowing in the cold accumulator. Accordingly, the refrigerant flowing in the high-pressure-side circuit disposed in the counterflow heat exchanger can be cooled indirectly by the other refrigerant flowing in the cold accumulator. As a result, in a manner virtually similar to the case where the high-pressure-side circuit disposed in the counterflow heat exchanger is thermally brought into contact with the cold accumulator, the counterflow heat exchanger can be improved in terms of heat-exchanging efficiency, thereby remarkably upgrading a cooling system in terms of cooling efficiency.

In accordance with the fifth aspect of the present invention, it is possible to enhance the heat-exchanging efficiency of the counterflow heat exchanger disposed in the cooling circuit in which a working medium is circulated in the high-pressure-side circuit and the low-pressure-side circuit by the pressure delivering means. Therefore, a cooling system can be improved sharply in terms of cooling efficiency.

A sixth aspect of the present invention is characterized in that a cooling circuit is a Joule-Thomson circuit which includes cooling means for cooling a substance to be cooled, a high-pressure-side circuit, a low-pressure-side circuit, pressure delivering means for delivering cold from the high-pressure-side circuit to the low-pressure-side circuit in the cooling circuit, a first counterflow heat exchanger for thermally bringing the refrigerant, flowing in the high-pressure-side circuit, into contact with the refrigerant, flowing in the low-pressure-side circuit, a second counterflow heat exchanger for thermally bringing the refrigerant, flowing in the high-pressure-side circuit downstream with respect to the first counterflow heat exchanger, with the refrigerant, flowing in the low-pressure-side circuit upstream with respect to the first counterflow heat exchanger, and a Joule-Thomson valve disposed between the second counterflow heat exchanger and the cooling means in the high-pressure-side circuit. It is further characterized in that at least one of the high-pressure-side circuit and the low-pressure-side circuit is thermally brought into contact with a portion of a cold accumulator of a cold-accumulating refrigerator whose temperature is varied from a high temperature to a low temperature by the other refrigerant flowing therein.

In the sixth aspect of the present invention, the fifth aspect of the present invention is applied to a Joule-Thomson circuit. Specifically, at least one of a refrigerant discharged from pressure delivering means and flowing in a high-pressure-side circuit, and the refrigerant itself flowing in a low-pressure-side circuit and suctioned into the pressure delivering means can be cooled by the other refrigerant flowing in a cold accumulator. Thus, a first counterflow heat exchanger and a second counterflow heat exchanger can be enhanced in terms of heat-exchanging efficiency. As a result, the temperature of the refrigerant flowing into a Joule-Thomson valve can be reduced efficiently, and accordingly the refrigerant of low pressure flowing out of the Joule-Thomson valve can be upgraded in terms of liquefied yield. All in all, a substance to be cooled can be cooled with remarkably improved cooling efficiency.

In accordance with the sixth aspect of the present invention, the temperature of the high-pressure refrigerant flowing into the Joule-Thomson valve can be reduced efficiently by an action similar to that of the fifth aspect of the present invention, and accordingly the low-pressure refrigerant flowing out of the Joule-Thomson valve can be upgraded in terms of liquefied yield. Hence, the substance to be cooled can be cooled with remarkably improved cooling efficiency.

A seventh aspect of the present invention is characterized in that a cold-accumulating refrigerator includes a compression chamber in which a first refrigerant is compressed, a chiller for dissipating heat resulting from the compression of the first refrigerant, a plurality of cold accumulators respectively communicating with the chiller and an expansion chamber in which the first refrigerant, transferred via the cold accumulators, is expanded, and that a cooling circuit includes a heat exchanger as well as a high-pressure-side circuit and a low-pressure-side circuit in which a second refrigerant flows, and which are disposed in the heat exchanger. It is further characterized in that at least one of the high-pressure-side circuit and the low-pressure-side circuit, which are disposed in the heat exchanger, is thermally brought into contact with a portion of the cold accumulators of the cold-accumulating refrigerator whose temperature is varied from a high temperature to a low temperature by the first refrigerant flowing therein, at least one of the cold accumulators being free from the thermal contact.

In the seventh aspect of the present invention, a cold accumulator can preferably be disposed in an expansion chamber. When a cold accumulator is simply disposed in an expansion chamber, and when the cold accumulator is thermally brought into contact with a heat exchanger, an entire construction of a cooling system is likely to be complicated. Accordingly, in the seventh aspect of the present invention, a plurality of cold accumulators are provided, some of the cold accumulators free from the thermal contact with a heat exchanger are disposed in an expansion chamber, and the rest of the cold accumulators, being thermally brought into contact with the heat exchanger, are disposed outside the expansion chamber. Thus, an overall construction of a cooling system can be simplified.

In accordance with the seventh aspect of the present invention, when disposing a plurality of the cold accumulators in the expansion chamber in order to downsize an entire cooling system, some of the cold accumulators free from the thermal contact with the heat exchanger are disposed in the expansion chamber, and the rest of the cold accumulators being thermally brought into contact with the heat exchanger are disposed outside the expansion chamber. Therefore, it is possible to simplify an overall construction of a cooling system.

In the present invention, the cold-accumulating refrigerator can be a Stirling refrigerator, a Gifford-McMahon refrigerator, a Solvay refrigerator, a Willmayer refrigerator, a pulse pipe refrigerator, etc.

In the present invention, the cooling circuit can be a refrigerant circuit for air-conditioners or refrigerators, or a gas passage which is cooled directly. When employing the refrigerant circuit, the pressure delivering means can be a compressor or a pump. When employing the directly-cooled gas passage, the pressure delivering means can be a blower.

The present invention can preferably be applied to multi-staged cold-accumulating refrigerators.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIGS. 4(A) and (B) are cross-sectional views of a specific example on a thermal-contact construction between a cold accumulator and a distributor heat exchanger in the Second Preferred Embodiment, where in:

FIG. 4(A) is a lateral cross-sectional view thereof; and

FIG. 4(B) is a cross-sectional view taken along the lines I—I of FIG. 4(A);

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

Figure 1:
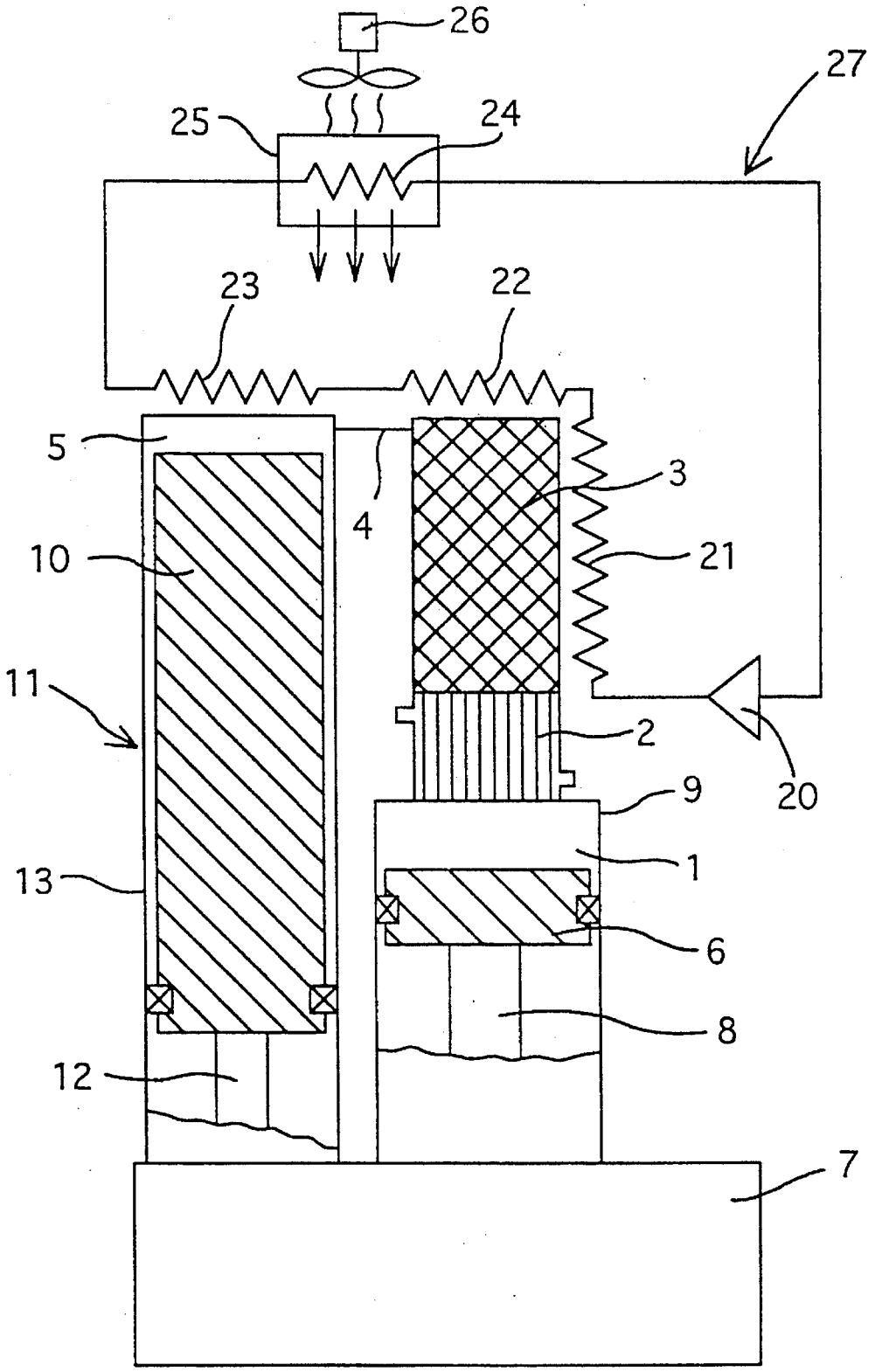
FIG. 1 is a conceptional diagram of a First Preferred Embodiment of a cooling system which embodies the first and second aspects of the present invention.

FIG. 1 is a conceptional diagram of a First Preferred Embodiment of a cooling system which embodies the first and second aspects of the present invention. As illustrated in FIG. 1, this cooling system comprises a single-motion and double-piston type refrigerator 11, and a cooling circuit 27 for cooling a substance 25 to be cooled.

The single-motion and double-piston type refrigerator 11 includes a compression cylinder 9 into which a piston 6 is fitted, an expansion cylinder 13 into which a piston 10 is fitted, a water-cooling chiller 2 which communicates with a compression chamber 1 in the compression cylinder 9, a cold accumulator 3 which communicates with the chiller 2, and a pipe 4 which communicates the cold accumulator 3 with an expansion chamber 5 in the expansion cylinder 13. The piston 6 disposed in the compression cylinder 9 and the piston 10 disposed in the expansion cylinder 13 are driven via rods 8, 12 by a power-driving apparatus 7 which, for instance, includes a crank mechanism and a motor. The power-driving apparatus 7 reciprocates the pistons 6, 10 at a predetermined relative phase difference, for example, at a phase difference of 90°.

The cooling circuit 27 includes pressure delivering means 20 which can be a compressor, a pump, etc., and a heat exchanger 24 which constitutes cooling means for cooling the substance 25 to be cooled. The pressure delivering means 20 and the heat exchanger 24 are disposed like a loop, and are connected by pipes. Between an outlet port of the pressure delivering means 20 and the heat exchanger 24, there are disposed, in a direction along the flow of a working medium in the cold accumulator 3, s distributor heat exchanger 21 which are thermally brought into contact with an outer peripheral surface of the cold accumulator 3, a pre-cooling heat exchanger 22 which are thermally brought into contact with a low-temperature end (i.e., cold head) of the cold accumulator 3, and a pre-cooling heat exchanger 23 which are thermally brought into contact with a low-temperature end (i.e., cold head) of the expansion cylinder 13 in this order. The distributor heat exchanger 21 as well as the pre-cooling heat exchangers 22, 23 correspond to the cold-conducting heat exchanger in the first and second aspects of the present invention. In addition, the heat exchanger 24 is disposed on the substance 25 to be cooled, and is heated by air blowing means 26.

Figure 2:
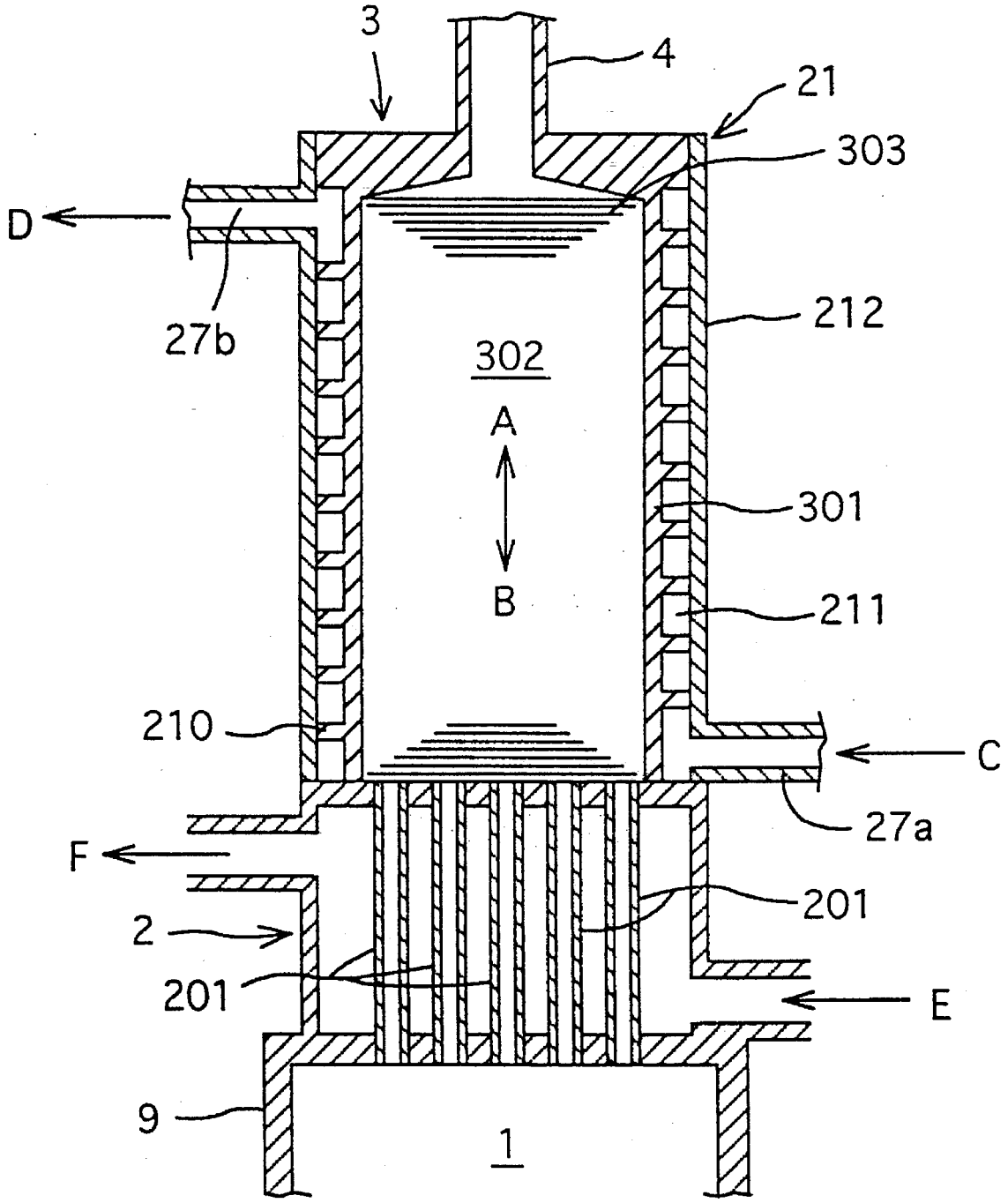
FIG. 2 is a cross-sectional view of a specific example on a thermal-contact construction between a cold accumulator and a distributor heat exchanger in the First Preferred Embodiment.

FIG. 2 illustrates a specific example on a thermal-contact construction between the cold accumulator 3 and the distributor heat exchanger 21. As illustrated in FIG. 2, the cold accumulator 3 includes a container 301 whose low-temperature end (i.e., top end) communicates with the pipe 4, and whose high-temperature end (i.e., bottom end) communicates with a plurality of fine pipes 201 constituting part of the chiller 2, and a cold-accumulating member 303 which is disposed in an inner chamber 302 of the container 301. The cold-accumulating member 303 can be copper balls, lead balls, bronze wire nets, and so on. The fine pipes 201 communicate with the compression chamber 1 of the compression cylinder 9 so as to cool a working medium (hereinafter referred to as a "first refrigerant"), such as helium or the like, when the first refrigerant reciprocates between the compression chamber 1 and the expansion chamber 5 (shown in FIG. 1). This cooling is carried out by cooling water which is supplied from an end of the chiller 2 and discharged to the other end thereof (e.g., in the direction shown by the arrows "E" and "F" of the drawing).

The distributor heat exchanger 21 includes outer-peripheral fins 210 which project like a spiral from the outer periphery of the container 301, a spiral groove 211 which is formed by the outer-peripheral fins 210, and an outer cylinder 212 which surrounds the spiral groove 211. At a beginning end of the spiral groove 211, there is formed an inlet port **27*a* into which a working medium (hereinafter referred to as a "second refrigerant"), such as helium or the like, is introduced out of the pressure delivering means 20. At a terminating end of the spiral groove 211, there is formed an outlet port 27*b* from which the second refrigerant is discharged to the pre-cooling heat exchangers 22, 23. In the First Preferred Embodiment, the pre-cooling heat exchanger 22 is disposed at a low-temperature end of the cold accumulator 3**.

The operations of the thus constructed cooling system will be hereinafter described. The piston 6 of the compression cylinder 9 compresses the first refrigerant with the retarded 90° phase difference with respect to the piston 10 of the expansion cylinder 13. When the piston 6 compresses the first refrigerant, the first refrigerant is heated to about 300 K in the compression chamber 1, and cooled to room temperature substantially while it passes through the fine pipes 201. When the first refrigerant passes through the cold accumulator 3, it is cooled to low temperature by the cold-accumulating member 303 gradually in the direction of its flow designated at the arrow "A" of the FIG. 2. Further, the first refrigerant passes through the pipe 4, and flows into the expansion chamber 5. Then, the piston 10 is operated to expand the expansion chamber 5, and accordingly cold of further lower temperature is produced in the expansion chamber 5. Thereafter, the piston 10 is operated to contract the expansion chamber 5, and the first refrigerant flows back into the compression chamber 1. Thus, one cooling cycle is completed in the refrigerator 11.

The second refrigerant flowing in the cooling circuit 27 is compressed by the pressure delivering means 20, and is moved in the spiral groove 211 of the distributor heat exchanger 21 in the axial direction of the cold accumulator 3 designated at the arrow "A" of FIG. 2. Thus, the second refrigerant is cooled by the outer-peripheral fins 210 of the container 301. When the second refrigerator flows into the pre-cooling heat exchangers 22, 23 in this order, it is further cooled by the first refrigerant flowing at the low-temperature end of the cold accumulator 3 and by the first refrigerant held in the expansion chamber 5. After the second refrigerant leaves the pre-cooling heat exchanger 23, it flows into the cooling heat exchanger 24 to cool the substance 25 to be cooled. The second refrigerant, whose temperature is raised by cooling the substance 25 to be cooled, is sucked into the pressure delivering means 20. Thus, one cooling cycle is completed in the cooling circuit 27.

In the First Preferred Embodiment, when the second refrigerant flowing in the cooling circuit 27 moves through the spiral groove 211 of the distributor heat exchanger 21, it is thermally brought into contact with the outer-peripheral fins 210 (i.e., a portion of a cold accumulator whose temperature is varied from a high temperature to a low temperature). Under the circumstances, in a cross-section crossing perpendicularly with the flow of the first refrigerant, warm energy comes in from the high-temperature end to the low-temperature end, and cold energy comes out from the low-temperature end to the high-temperature end. In a refrigerator, the cold energy is larger than the warm energy in a cross-section crossing perpendicularly with the flow of the first refrigerant in one cooling cycle. When considering the entire cold accumulator 3, the first refrigerant flowing in the cold accumulator 3 can be regarded as a sort of expansion cylinder. Thus, the cold accumulator 3 produces cold.

Regarding the distributor heat exchanger 21 according to the first aspect of the present invention, not only it is simply integrated with the cold accumulator 3, but also it is thermally brought into contact with a portion of the accumulator 3 whose temperature is varied from a high temperature to a low temperature by the first refrigerant. Considering this arrangement from the perspective of the Carnot efficiency, the First Preferred Embodiment can produce cold more than the case where cold is obtained from a portion having a specific temperature.

As can be appreciated from Table 1 below, when the refrigerator 11 is operated with an identical required electricity, the higher the temperature of the expansion chamber 5 (i.e., a cold output port) is, the larger the Carnot efficiency is. Here, the Carnot efficiency (η) is expressed by the following expression:

$$\eta=T_E/(T_C-T_E),$$

wherein $T_C$ is a temperature at the compression chamber 1; and $T_E$ is a temperature at the expansion chamber 5.

TABLE 1

| $T_E$ | 250K | 200K | 150K | 100K | 50K | 40K | 30K | 20K | 10K |
|---|---|---|---|---|---|---|---|---|---|
| η | 5 | 2 | 1 | 0.5 | 0.2 | 0.15 | 0.111 | 0.0714 | 0.0344 |

Table 1 suggests that cold can be produced more by continuously cooling in a temperature range of from 300 to 50K than by cooling at a specific temperature, e.g., at 50K. Likewise, in the cold accumulator 3, cold can be produced much more by cooling in a continuous temperature range than by cooling at a temperature of a low-temperature end of the cold accumulator 3 or at a temperature of the expansion chamber 5.

Thus, in accordance with the First Preferred Embodiment, the cooling efficiency can be enhanced, because cold can be produced from a continuous temperature range which results from the flow of first refrigerant in the cold accumulator According to the experiments conducted by the present inventors, the refrigeration of the second refrigerant cooled by the distributor heat exchanger 21 was found to reach approximately at least three times as much as the refrigeration of the second refrigerant cooled by both of the pre-cooling heat exchangers 22, 23.

In addition, in accordance with the First Preferred Embodiment (e.g., the second aspect of the present invention), the refrigeration of the second refrigerant cooled by the low-temperature end of the expansion chamber 5 at the pre-cooling heat exchanger 23, and the refrigeration thereof cooled by the low-temperature end of the cold accumulator 3 at the pre-cooling heat exchanger 22 are added to the above-described enlarged refrigeration. Hence, the cooling efficiency can be further enhanced.

As a modified version of the First Preferred Embodiment, a spiral pipe can be brazed on an outer periphery of the container 301 of the cold accumulator 3, thereby constituting part of the cooling circuit 27. This modified version can produce the same advantageous effects as those produced by the First Preferred Embodiment.

Second Preferred Embodiment

Figure 3:
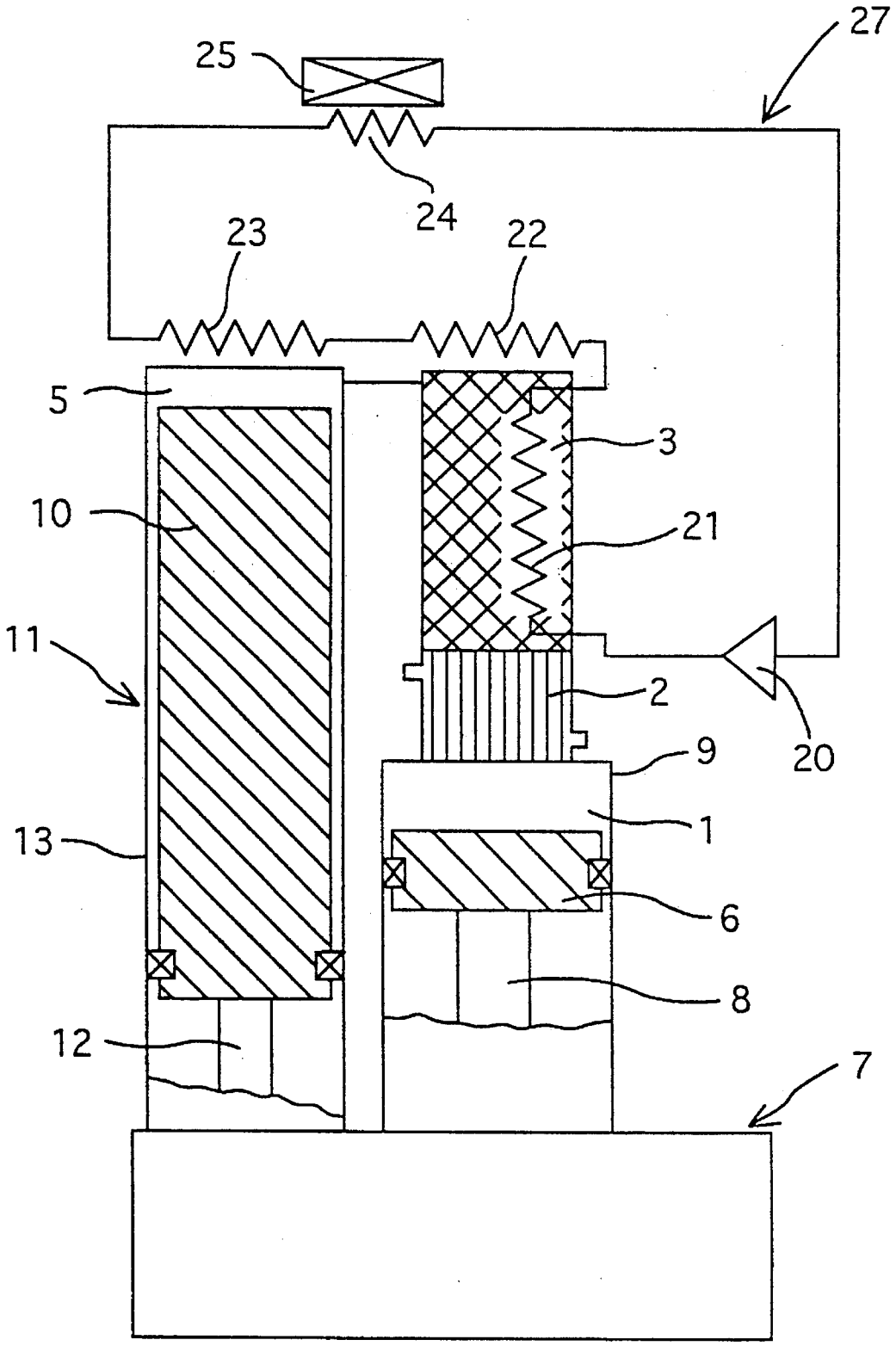
FIG. 3 is a conceptional diagram of a Second Preferred Embodiment of a cooling system which embodies the third aspect of the present invention.

A Second Preferred Embodiment embodies the third aspect of the present invention. FIG. 3 illustrates its concept. As illustrated in the drawing, it is characterized in that a distributor heat exchanger 21 is disposed in a cold accumulator 3.

Figure 4:
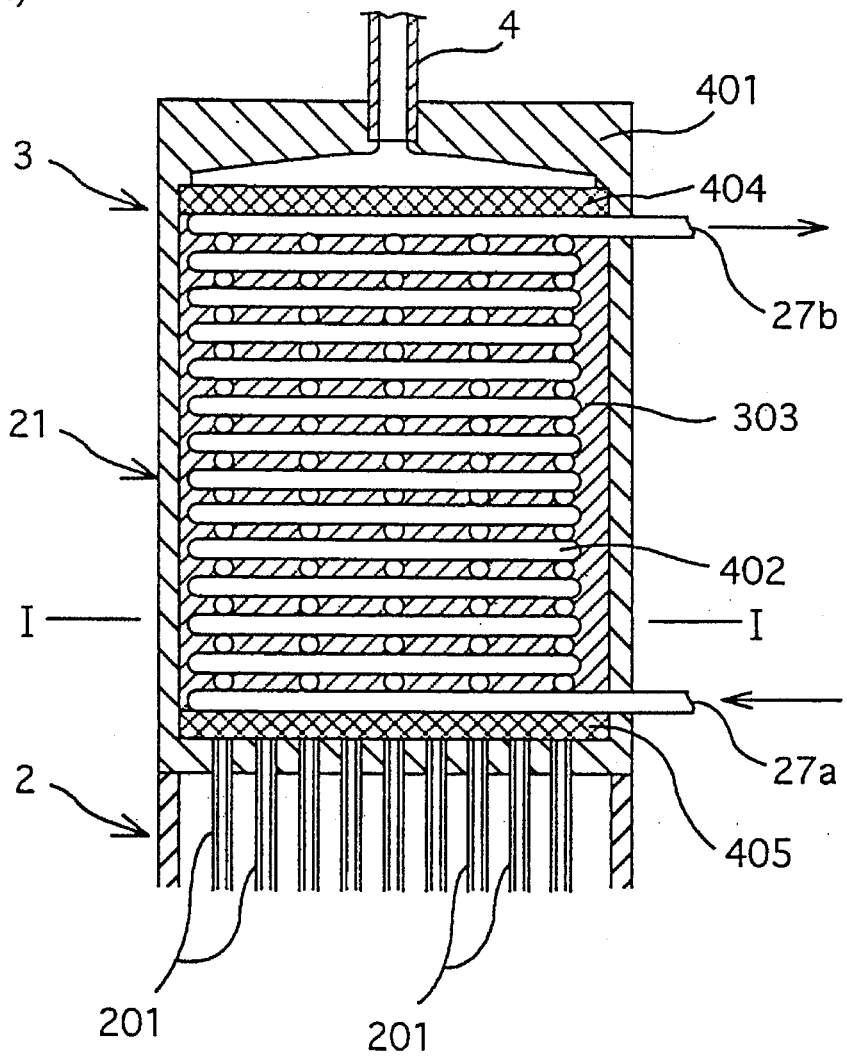
Figure 4:
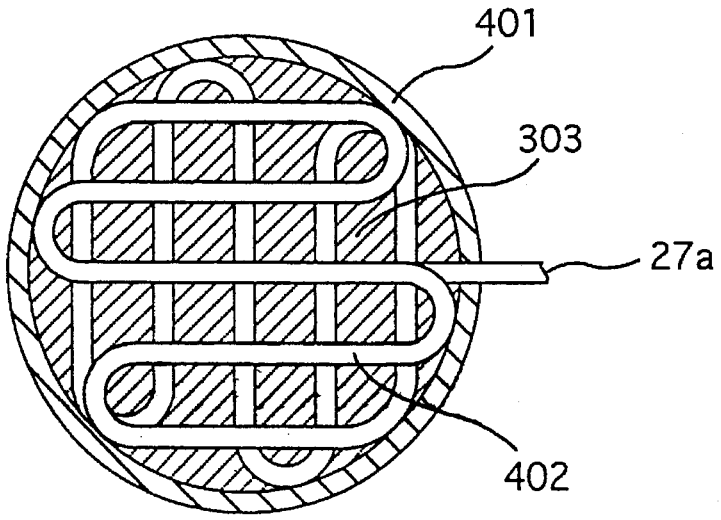

FIGS. 4(A) and (B) illustrate a specific construction which is adapted for disposing the distributor heat exchanger 21 in the cold accumulator 3. In FIGS. 4(A) and (B), a container of the cold accumulator 3 is designated at 401. The inside of the container 401 communicates with a chiller 2 which has fine pipes 201 and which is constructed similarly to that of the First Preferred Embodiment. Further, at a low-temperature end of the container 401, there is disposed part of a pipe 4 which communicates with an expansion chamber 5. Furthermore, at the low-temperature end and a high-temperature end of the container 401, there are fitted distributors 404, 405, respectively. As illustrated in FIG. 4(B), in the space formed between the distributors 404, 405, there is disposed a pipe 402 which constitutes the distributor heat exchanger 21, and which is laminated from the high-temperature end to the low-temperature end in a complex winding shape so as to form a space for allowing a cold-accumulating member 3 therein. A high-temperature end of the pipe 402 projects from the container 401 to the outside, and constitutes an inlet port 27*a* for receiving a second refrigerant which is delivered by pressure delivering means 20 of a cooling circuit 27. A low-temperature end of the pipe 402 constitutes an outlet port 27*b* for discharging the second refrigerant to pre-cooling heat exchangers 22, 23 of the cooling circuit 27.

The thus arranged thermal-contact construction between the cold accumulator 3 and the distributor heat exchanger 21 (e.g., the laminated pipe 402) remarkably increases the thermal contactability between the cold accumulator 3 and the distributor heat exchanger 21. As a result, cold can be obtained efficiently, and the cooling efficiency can be enhanced.

Third Preferred Embodiment

Figure 5:
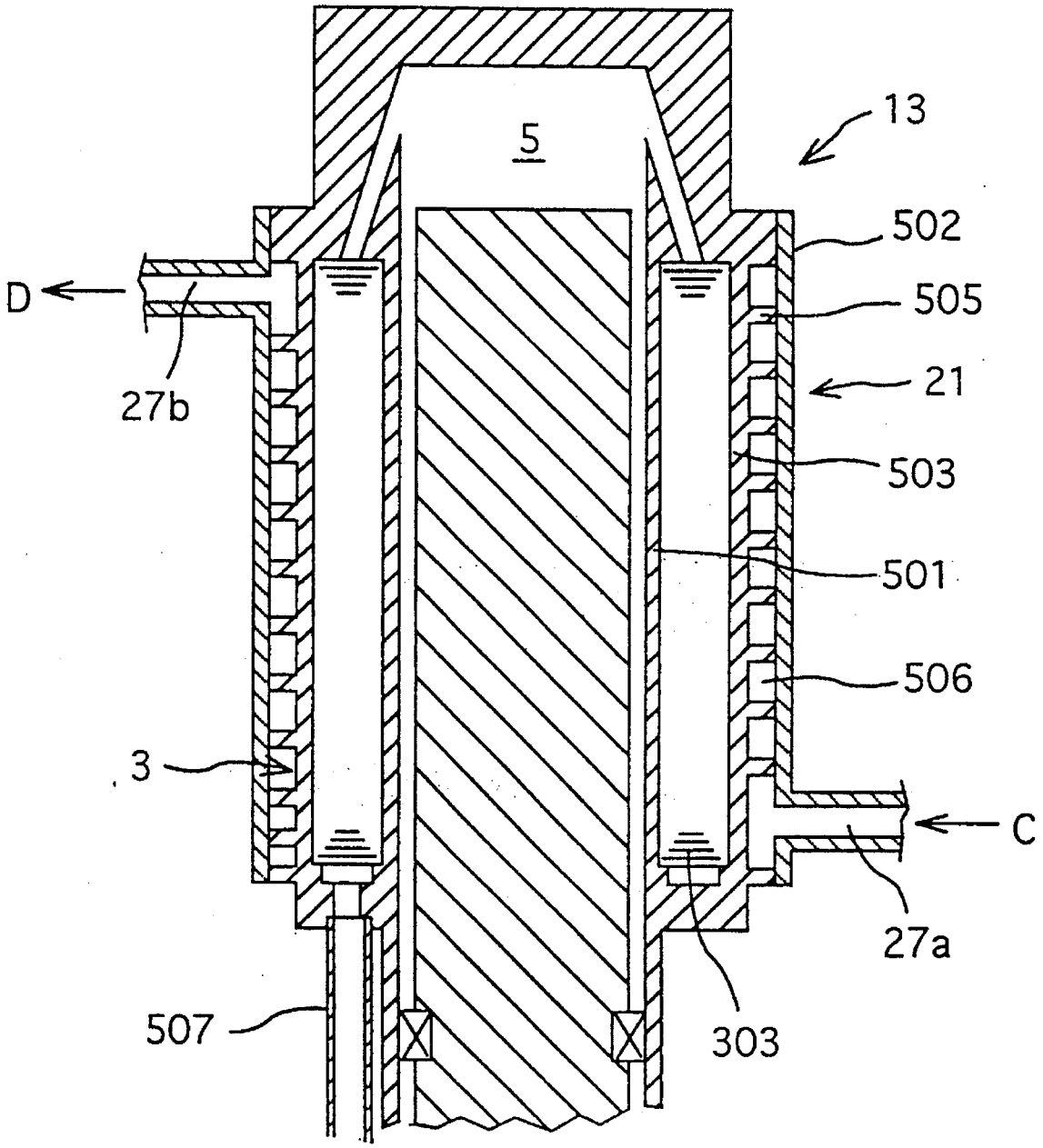
FIG. 5 is a cross-sectional view of a specific example on a thermal-contact construction between a cold accumulator and a distributor heat exchanger in a Third Preferred Embodiment of a cooling system which embodies the first aspect of the present invention.

As illustrated in FIG. 5, in accordance with a thermal-contact construction between a Third Preferred Embodiment, a cold accumulator 3 and a distributor heart exchanger 21 are formed dually and coaxially around a cylindrical member 501 which constitutes an expansion cylinder 13.

For instance, an outer cylindrical member 502 of a larger diameter is superimposed around an outer periphery of the cylindrical member 501, and a partition wall 503 is held between the cylindrical member 501 and the outer cylindrical member 502. In an inner space defined between the cylindrical member 501 and the partition wall 503, there is fitted a cold-accumulating member 303 so as to constitute the cold accumulator 3. In an outer space defined between the partition wall 503 and the outer cylindrical member 502, there are formed outer-peripheral fins 505 so as to project spirally from the partition wall 503 and to constitute the distributor heat exchanger 21. By thus forming the outer-peripheral fins 505, a spiral groove 506 is formed from a high-temperature end to a low-temperature end. The inner space, filled with the cold-accumulating member 303, communicates with a chiller (not shown) via a pipe 507. At a high-temperature end of the spiral groove 506, there is formed an inlet port 27*a* which communicates with pressure delivering means 20 of a cooling circuit 27. At s low-temperature end of the spiral groove 506, there is formed an outlet port 27*b* which communicates with pre-cooling heat exchangers 22, 23 of the cooling circuit 27.

In accordance with the thus constructed Third Preferred Embodiment, the volumes of the cold accumulator 3 and the distributor heat exchanger 21 can be enlarged, and accordingly the thermal contactability can be enhanced between the cold accumulator 3 and the distributor heat exchanger 21. As a result, the cooling efficiency can be earned effectively. At the same time, the expansion cylinder 13, the cold accumulator 3 and the distributor heat exchanger 21 are integrated so that the cooling system can be downsized as a whole.

Fourth Preferred Embodiment

Figure 6:
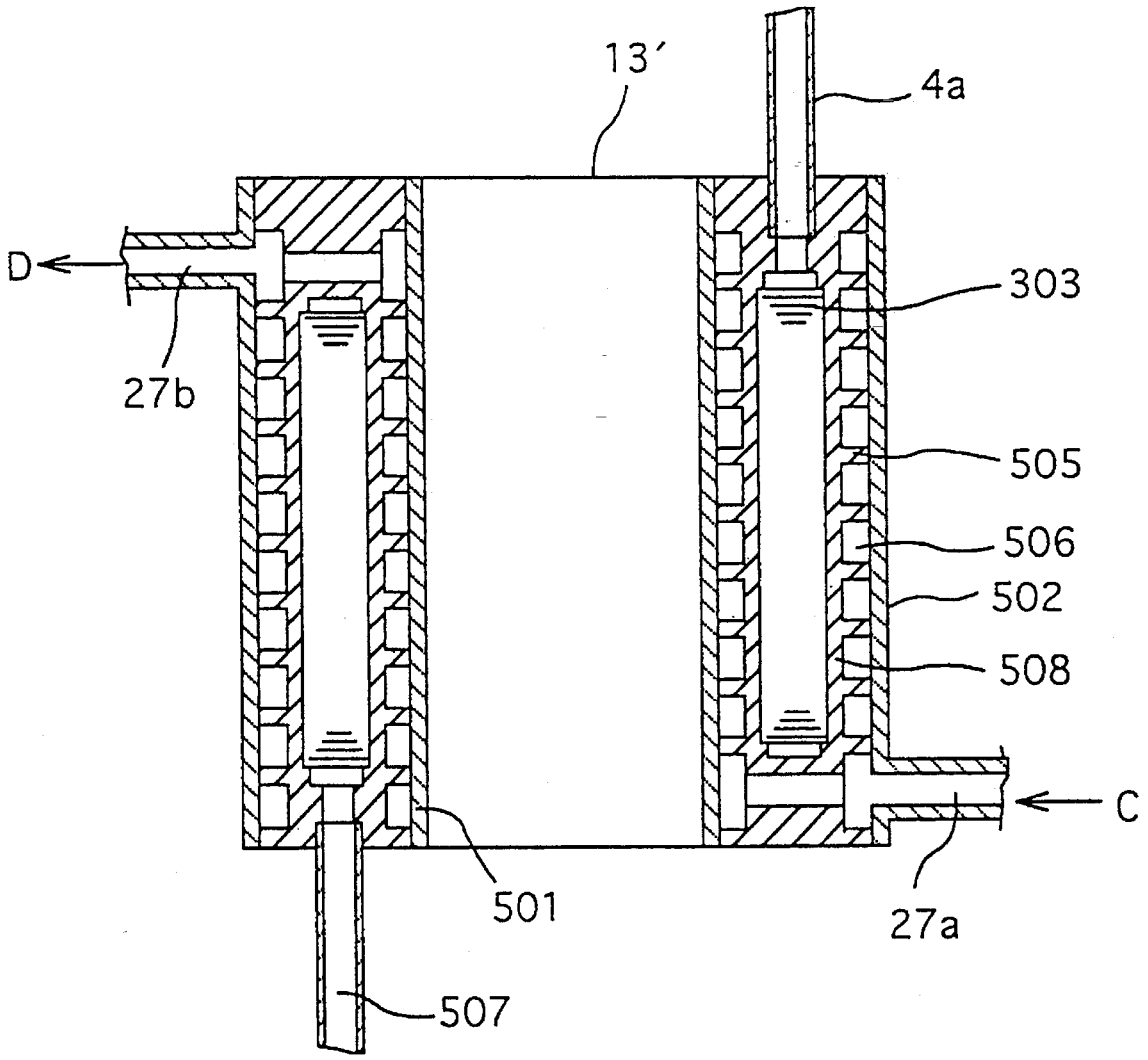
FIG. 6 is a cross-sectional view of a specific example on a thermal-contact construction between a cold accumulator and a distributor heat exchanger in a Fourth Preferred Embodiment of a cooling system which embodies the first aspect of the present invention.

As illustrated in FIG. 6, a thermal-contact construction of a Fourth Preferred Embodiment also comprises a cylindrical member 501 which constitutes a portion 13' of an expansion cylinder 13, a cold accumulator 3, and a distributor heat exchanger 21. The cold accumulator 3 and the distributor heat exchanger 21 are disposed integrally with the cylindrical member 501. The thermal-contact construction of the Fourth Preferred Embodiment differs from that of the Third Preferred Embodiment in that a duplex partition wall 508 is fitted into the space formed between the cylindrical member 501 and an outer cylindrical member 502. The duplex partition wall 508 constitutes the cold accumulator 3 into which a cold-accumulating member 303 is filled in an annular shape. In the duplex partition wall 508, there are formed fins 505 so as to project from the inner periphery and the outer periphery and to form a duplex spiral groove 506. An end of the duplex partition wall 508 communicates with a chiller (not shown) via a pipe 507, and the other end thereof communicates with an expansion chamber 5 (shown in FIG. 1) via a pipe 4*a*.

In accordance with the thus constructed Fourth Preferred Embodiment, the cooling system can be downsized as a whole similarly to the Third Preferred Embodiment. At the same time, the duplex groove 506 further securely increases the thermal-contact surface area on which the second refrigerant thermally contacts with the fins 505. All in all, the cooling efficiency can be furthermore enhanced.

Fifth Preferred Embodiment

A cooling system embodying the fifth aspect of the present invention will be hereinafter described with reference to FIG. 7.

Figure 7:
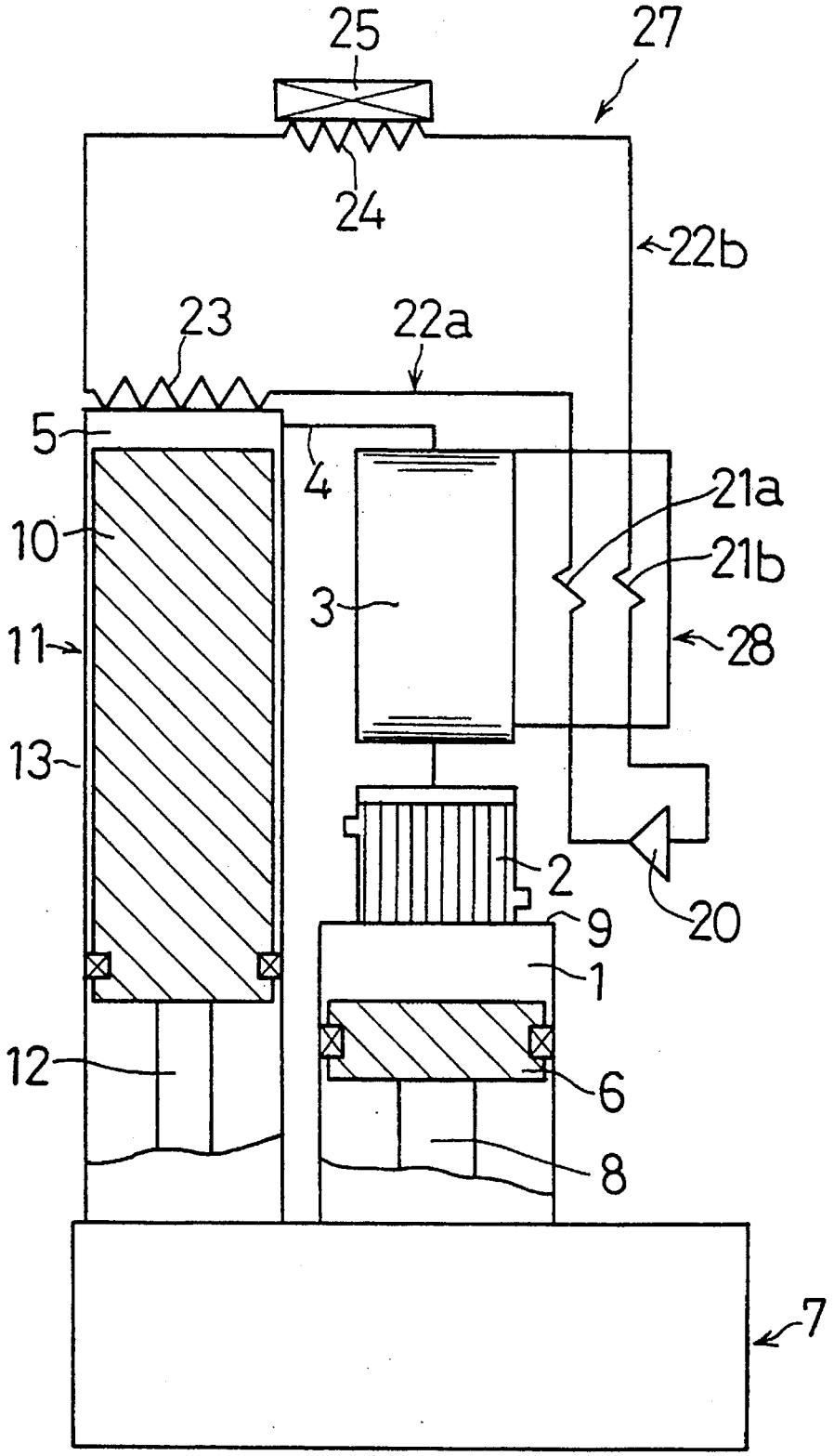
FIG. 7 is a conceptional diagram of a Fifth Preferred Embodiment of a cooling system according to the present invention.

Similar to the cooling system according to the First Preferred Embodiment illustrated in FIG. 1, a cooling system according to a Fifth Preferred Embodiment illustrated in FIG. 7 also comprises a single-motion and double-piston type refrigerator 11 which includes a cold accumulator 3, and a cooling circuit 27 for cooling a substance 25 to be cooled. The Fifth Preferred Embodiment differs from the First Preferred Embodiment illustrated in FIG. 1 in that, instead of the distributor heat exchanger 21, it utilizes a counterflow heat exchanger 28 as the cold-conducting heat exchanger in its cooling circuit 27.

Specifically, the cooling circuit 27 is divided into a high-pressure-side circuit 22*a* and a low-pressure-side circuit 22*b* by a pressure delivering means 20. A second refrigerant is discharged out of a discharge port of the pressure delivering means 20. The second refrigerant is then flowed in one of the heat-exchanging elements of the counterflow heat exchanger 28 (e.g., a heat-exchanging element 21*a*, hereinafter referred to as a "high-pressure-side heat-exchanging passage 21*a*") which is disposed in the high-pressure-side circuit 22*a*, and it is supplied to the pre-cooling heat exchanger 23. Further, the second refrigerant is used to cool the substance 25 to be cooled while it is flowed in a heat exchanger 24 for cooling, and thereafter it is flowed in the other one of the heat-exchanging elements of the counterflow heat exchanger 28 (e.g., a heat-exchanging element 21*b*, hereinafter referred to as a "low-pressure-side heat-exchanging passage 21*b*"). Finally, the second refrigerant is sucked into an inlet port of the pressure delivering means 20.

This Fifth Preferred Embodiment is characterized in that the high-pressure-side heat-exchanging passage 21*a* is thermally brought into contact with a portion of the cold refrigerator 3 of the refrigerator 11 whose temperature is varied from a high temperature to a low temperature. In other words, it is characterized in that the high-pressure-side heat-exchanging passage 21*a* is disposed so as to extend along the flowing direction of the first refrigerant in the cold accumulator 3, and thereby it is thermally brought into contact with the first refrigerant.

Figure 8:
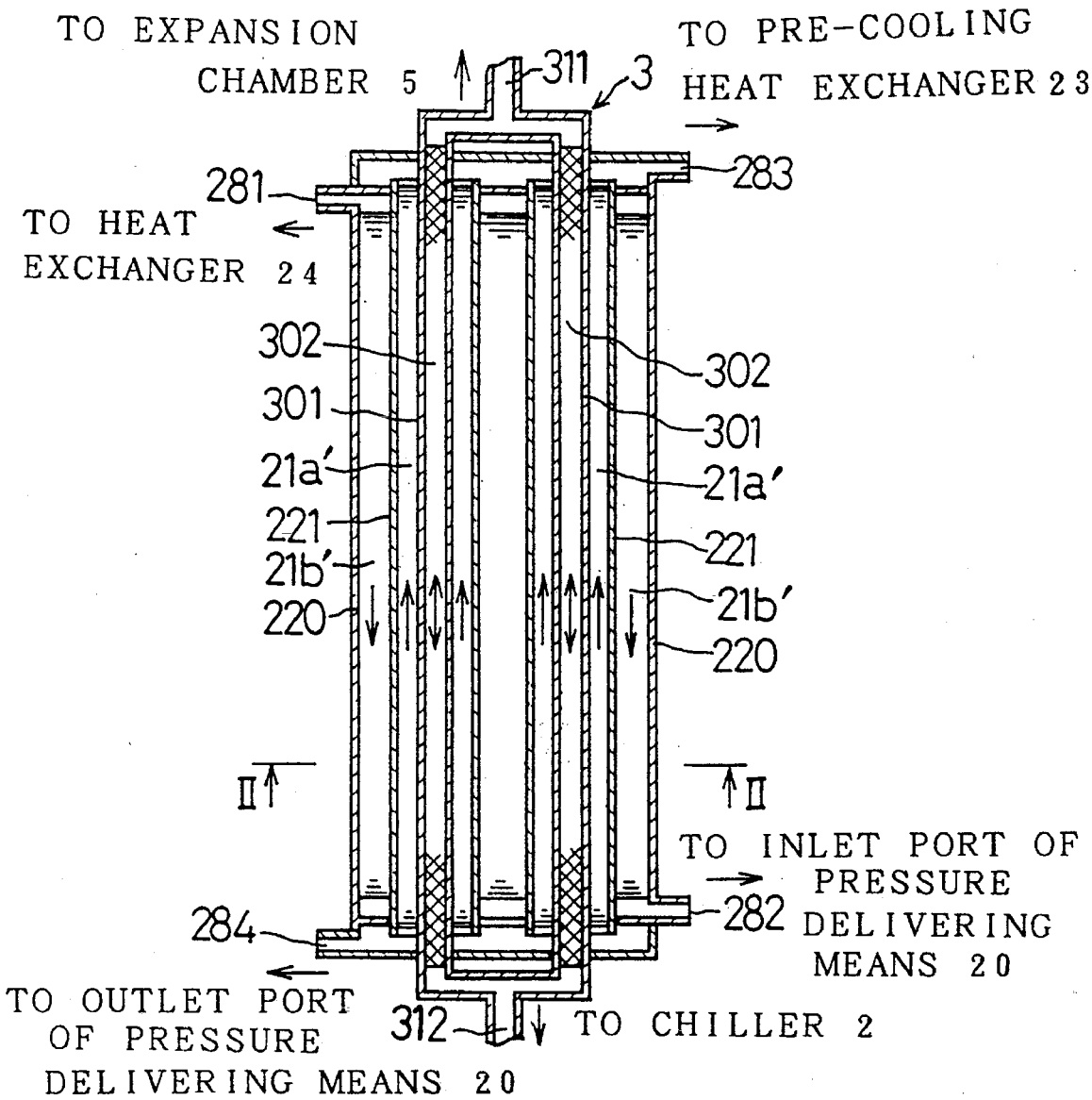
FIG. 8 is a cross-sectional view for illustrating a specific example on a thermal-contact construction between a cold accumulator and a counterflow heat exchanger which is employed in the Fifth Preferred Embodiment.
Figure 9:
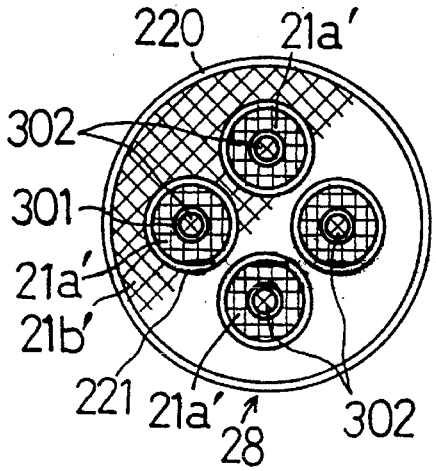
FIG. 9 is a cross-sectional view for illustrating a cross-sectional construction thereof taken along lines II—II of FIG. 8.

FIGS. 8 and 9 illustrate a specific construction on how the high-pressure-side passage 21*a* of the counterflow heat exchanger 28 is thermally brought into contact with a portion of the cold refrigerator 3 whose temperature is varied from a high temperature to a low temperature.

As illustrated in FIG. 9, the cold accumulator 3 includes four containers 301 in which a cold-accumulating member 302 is filled. The counterflow heat exchanger 28 includes four outer pipes 221 in which a high-pressure-side heat-exchanging member 21*a'* is disposed so as to be thermally brought into contact with the first refrigerant flowing in the cold-accumulating member 302, and an outer-jacket container 202 in which a low-pressure-side heat-exchanging member 21*b'* is disposed. As illustrated in FIG. 8, the pipes 221 and the containers 301 are communicated at the top and bottom, respectively. The pipes 221 are communicated with the outlet port of the pressure delivering means 20 at a lower-end inlet port 284, and they are communicated with the pre-cooling heat exchanger 23 at a top-end outlet port 283. The outer-jacket container 220 is communicated with the heat exchanger 24 for cooling at an upper-end inlet port 281, and it is communicated with the inlet port of the pressure delivering means 20 at a lower-end outlet port 282. The container 301 constituting the cold accumulator 3 is communicated with the expansion chamber 5 at an upper-end outlet port 311 (i.e., a cold-temperature end), and it is communicated with the chiller 2 at a lower-end inlet port 312 (i.e., a high-temperature end).

In the thus constructed cooling system, the high-pressure-side heat-exchanging passage 21*a* of the counterflow heat exchanger 28 is thermally brought into contact with the cold accumulator 3 directly. Accordingly, the second refrigerant flowing in the high-pressure-side heat-exchanging passage 21*a* is cooled by the first refrigerant flowing in the cold accumulator 3, and simultaneously it is also cooled by the second refrigerant flowing in the low-pressure-side heat-exchanging passage 21*b*.

When a working medium is circulated in the high-pressure-side circuit 22*a* and the low-pressure-side circuit 22*b* by the pressure delivering means 20, and when the high-pressure-side circuit 22*a* and the low-pressure-side circuit 22*b* are simply connected by the counterflow heat exchanger 28, the high-temperature second refrigerant flowing in the high-pressure-side circuit 22*a* is cooled only by the second refrigerant flowing in the low-pressure-side circuit 22*b*.

On the other hand, in the Fifth Preferred Embodiment, the second refrigerant flowing in the high-pressure-side circuit 22*a* is further cooled by the first refrigerant flowing in the cold accumulator 3. In addition, the second refrigerant flowing in the high-pressure-side heat-exchanging passage 21*a* is thermally brought into contact with the first refrigerant flowing in the cold accumulator 3. To put it differently, the second refrigerant flowing in the high-pressure-side heat-exchanging passage 21*a* is thermally brought into contact with a portion of the cold accumulator 3 whose temperature is varied from a high temperature to a low temperature. Hence, as described for the First Preferred Embodiment illustrated in FIG. 1, the Fifth Preferred Embodiment is improved in terms of efficiency over the case where cooling is carried out by specific-low-temperature cold which is produced in the expansion chamber 5 of the refrigerator 11. As a result, the counterflow heat exchanger 28 is enhanced in terms of heat-exchanging efficiency, and refrigeration via the heat exchanger 24 for cooling the substance 25 to be cooled is enlarged. All in all, the Fifth Preferred Embodiment can remarkably upgrade cooling systems in terms of cooling efficiency.

The Fifth Preferred Embodiment can be modified variously. For example, the second refrigerant flowing in the low-pressure-side heat-exchanging passage 21*b* of the counterflow heat exchanger 28 can be thermally brought into contact with the cold accumulator 3, and the second refrigerant flowing in the high-pressure-side heat-exchanging passage 21*a* as well as the second refrigerant flowing in the low-pressure-side heat-exchanging passage 21*b* can be thermally brought into contact with the cold accumulator 3. The former arrangement is described with reference to a Ninth Preferred Embodiment illustrated in FIGS. 13, 14 and 15. The latter arrangement is described with reference to a Tenth Preferred Embodiment illustrated in FIGS. 16 and 17.

Sixth Preferred Embodiment

Figure 10:
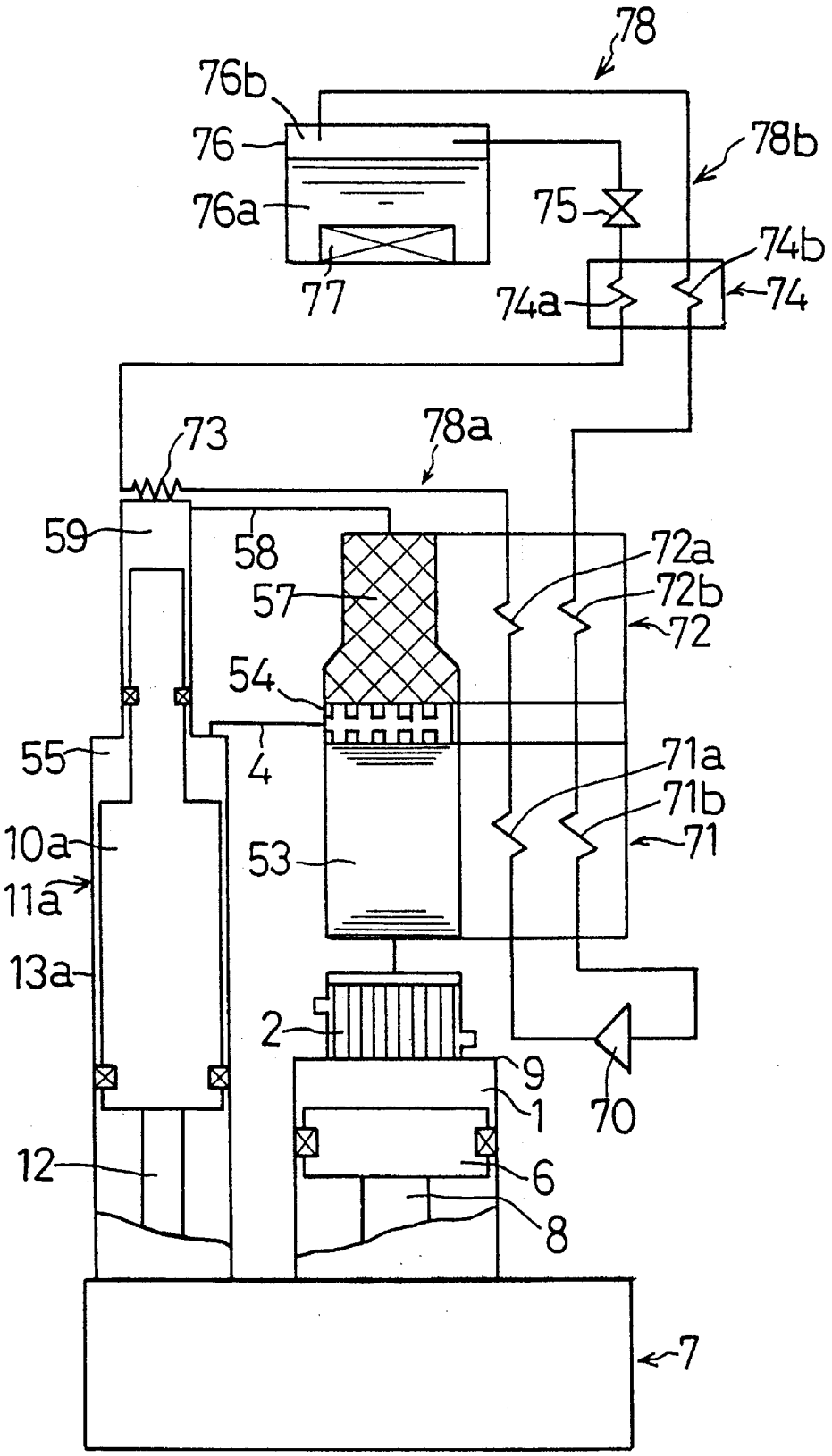
FIG. 10 is a conceptional diagram of a Sixth Preferred Embodiment of a cooling system according to the present invention.

The arrangements of the Fifth Preferred Embodiment per se can be applied to a J-T circuit. FIG. 10 illustrates a Sixth Preferred Embodiment which embodies the sixth aspect of the present invention. Specifically, a J-T circuit is adapted for constituting the cooling circuit 27 of the Fifth Preferred Embodiment illustrated in FIG. 7. In the Sixth Preferred Embodiment, a refrigerator 11*a* is employed whose expansion cylinder 13*a* is constructed in two-stage; namely: the expansion cylinder 13*a* has a first expansion chamber 55 and a second expansion chamber 59. In order to correspond with this two-stage construction, a piston 10*a* is also constructed in two-stage, a first cold accumulator 53 and a second cold accumulator 57 are laminated on a chiller 2 in two-stage. Note that, however, there is disposed a distributor 54 between the first and second accumulators 53, 57.

A J-T circuit 78 is capable of producing cold as low as a liquefied helium temperature, cooling a substance 75, such as a superconducting magnet, to be cooled, and producing liquefied helium. The substance 75 to be cooled is immersed in a liquid reservoir 76. Liquefied helium is produced by a Joule-Thomson valve 75, discharged out of a discharge port thereof, and kept in the liquid reservoir 76. The liquefied helium kept therein is vaporized by heat emitted from the substance 77 to be cooled as well as by heat intruding from the outside (e.g., conduction heat and radiation heat). The vaporized helium (i.e., a second refrigerant) is flowed, in the following order, in a low-pressure-side heat-exchanging passage 74*b* of a second counterflow heat exchanger 74, and in low-pressure-side heat-exchanging passages 72*b*, 71*b* of first counterflow heat exchangers 72, 71, which are disposed in the low-pressure-side circuit 78*b*. Finally, the vaporized helium is sucked into an inlet port of pressure delivering means 70.

The second refrigerant of high pressure, highly pressurized by the pressure delivering means 70, is first flowed in a high-pressure-side heat-exchanging passages 71*a*, 72*a* of the first counterflow heat exchangers 71, 72, which are disposed in a high-pressure-side circuit 78*a*. The second refrigerant is then flowed, in the following order, in a pre-cooling heat exchanger 73 being thermally brought into contact with the second expansion chamber 59, and in a high-pressure-side heat-exchanging passage 74*a* of the second counter flow heat exchanger 74. Finally, the second refrigerant is flowed into an inlet port of the Joule-Thomson valve 75. Thus, the high-pressure-side heat-exchanging passages 71*a*, 72*a* of the first counterflow heat exchangers 71, 72 are respectively thermally brought into contact with a portion of the first cold accumulator 53 and the second cold accumulator 57 whose temperature is varied from a high temperature to a low temperature.

The thus constructed J-T circuit 78 operates as follows. When the high-pressure second refrigerant, highly pressurized by the pressure delivering means 70, is flowed in the high-pressure-side heat-exchanging passages 71*a*, 72*a* of the first counterflow heat exchangers 71, 72, it is cooled respectively by the first refrigerant flowing in the first cold accumulator 53 and the second cold accumulator 57. At the same time, the second refrigerant is cooled by the low-pressure second refrigerant flowing in the low-pressure-side heat-exchanging passages 71*b*, 72*b*.

The high-pressure second refrigerant passed through the high-pressure-side heat-exchanging passage 72*a* is cooled to a further low temperature by the pre-cooling heat exchanger 73. Thereafter, when it is flowed in the high-pressure-side heat-exchanging passage 74*a* of the second counterflow heat exchanger 74, it is further cooled to a furthermore low temperature by the second refrigerant flowing in the low-pressure-side heat-exchanging passage 74*b* of the second counterflow heat exchanger 74. Thus, it is cooled to a temperature of about 5.7 K in front of the Joule-Thomson valve 75. When it is passed through the Joule-Thomson valve 75, it is subjected to constant-enthalpy expansion, and thereby part of the resulting gas is liquefied.

Likewise, in accordance with the Sixth Preferred Embodiment, the second refrigerant flowing in the high-pressure-side heat-exchanging passages 71*a*, 72*a* of the first counterflow heat exchangers 71, 72 is cooled by the first refrigerant flowing in the first and second accumulators 53, 57 as well as by the second refrigerant flowing in the low-pressure-side heat-exchanging passages 71*b*, 72*b*. Accordingly, the heat-exchanging efficiency of the first heat exchangers 71, 72 are enlarged, and thereby the second refrigerant is cooled remarkably efficiently before it reaches the Joule-Thomson valve 75. Thus, the second refrigerant flowing out of the Joule-Thomson valve 75 can be liquefied with high efficiency. As a result, the substance 77, like a superconducting magnet, to be cooled can be cooled with sharply improved cooling efficiency.

Seventh Preferred Embodiment

A cooling system according to a Seventh Preferred Embodiment embodying the seventh aspect of the present invention will be hereinafter described with reference to FIG. 11.

Figure 11:
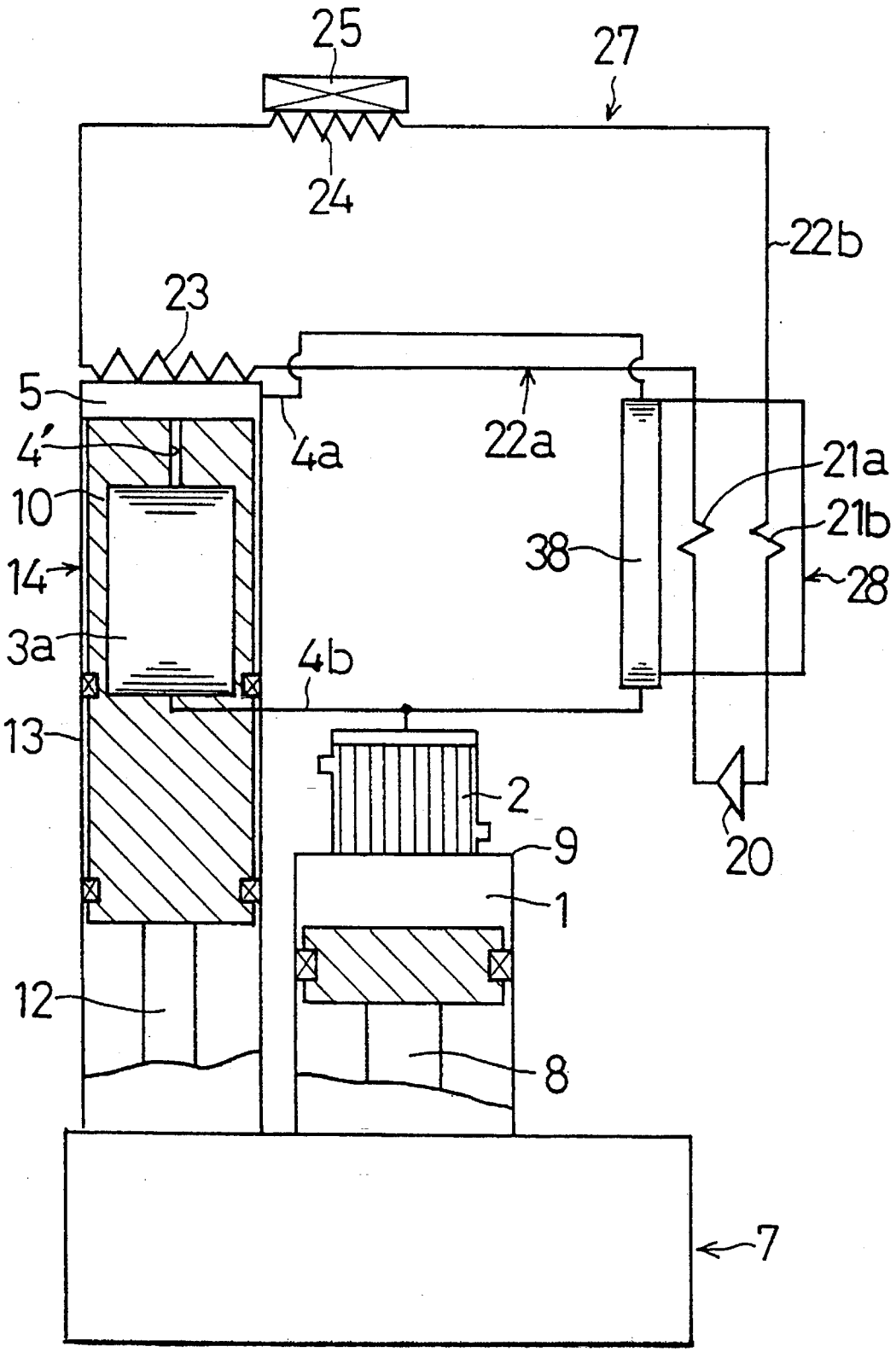
FIG. 11 is a conceptional diagram of a Seventh Preferred Embodiment of a cooling system according to the present invention.

In the cooling system illustrated in FIG. 11, there are disposed a plurality of cold accumulators in which a first refrigerant flows parallelly and reciprocatively between a chiller 2 and an expansion chamber 5. In the Seventh Preferred Embodiment, for instance, two cold accumulators 3*a*, 3*b* are disposed between a chiller 2 and an expansion chamber 5. Further, one of the cold accumulators 3*a*, 3*b*, for example, the cold accumulator 3*a* is disposed in an expansion piston 10 which is fitted into an expansion cylinder 14. The other cold accumulator 3*b* is thermally brought into contact with a high-pressure-side heat-exchanging passage 21*a* of a counterflow heat exchanger 28 in a manner similar to that of the Fifth Preferred Embodiment illustrated in FIG. 7.

When a cooling system is thus constructed; namely: when the cold accumulator 3*a* is disposed in the expansion cylinder 14, it is unnecessary to thermally bring the counterflow heat exchanger 28 into contact with the cold accumulator 3*a* which is disposed in the expansion piston 10. Hence, the construction of the Seventh Preferred Embodiment is little complicated.

Eighth Preferred Embodiment

When a counterflow heat exchanger is thermally brought into contact with a cold accumulator in accordance with the Fifth Preferred Embodiment illustrated in FIG. 7, and when a refrigerator operates at a high revolution, it is needed to make the cold accumulator relatively shorter (e.g., make its diameter larger) in order to reduce the pressure loss at the cold accumulator. On the other hand, it is preferred to make the counterflow heat exchanger longer in order to upgrade the efficiency.

Figure 12:
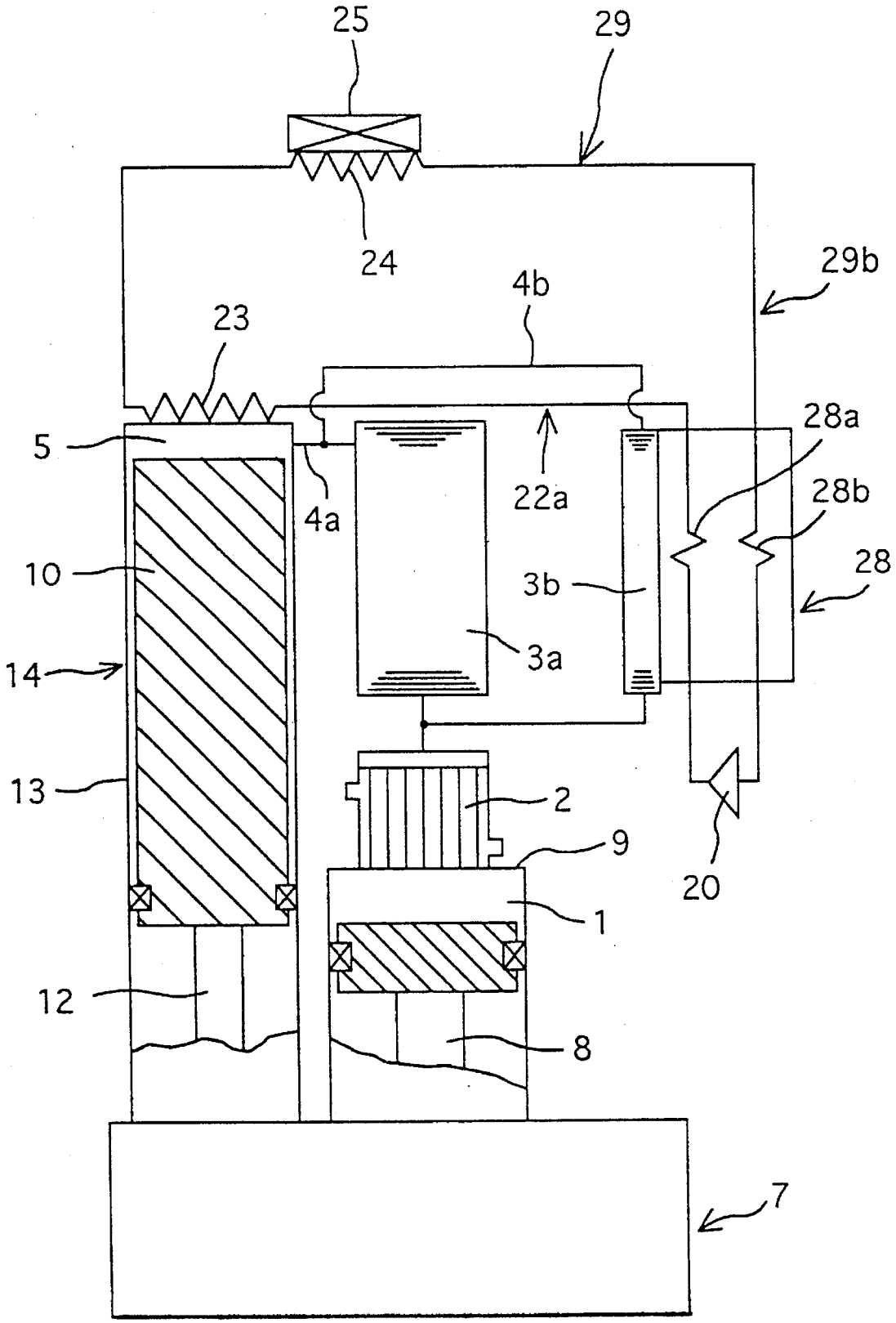
FIG. 12 is a conceptional diagram of an Eighth Preferred Embodiment of a cooling system according to the present invention.

Under the circumstances, as illustrated in FIG. 12, a cooling system according to an Eighth Preferred Embodiment comprises a plurality of cold accumulators (e.g., two cold accumulators 3*a*, 3*b*). In the Eighth Preferred Embodiment, both of the two cold accumulators 3*a*, 3*b* are disposed outside an expansion cylinder 14. One of the accumulators ( e.g., the accumulator 3*b*) is thermally brought into contact with a counterflow heat exchanger 28, and has a reduced diameter and an enlarged length allowing a predetermined flow which does not adversely affect the pressure loss. Thus, the counterflow heat exchanger 28 can exhibit a required efficiency securely. At the same time, the other one of the cold accumulators (e.g., the accumulator 3*a*) free from the thermal-contact with the counterflow heat exchanger 28 can be made shorter comparatively.

Ninth Preferred Embodiment

In all of the Fifth through Eighth Preferred Embodiments, a cold accumulator is thermally brought into contact with a high-pressure-side heat-exchanging passage of a counterflow heat exchanger. Note that, however, a cold accumulator can be thermally brought into contact with a low-pressure-side heat-exchanging passage of a counterflow heat exchanger in accordance with a cooling system according to a Ninth Preferred Embodiment hereinafter described.

Figure 13:
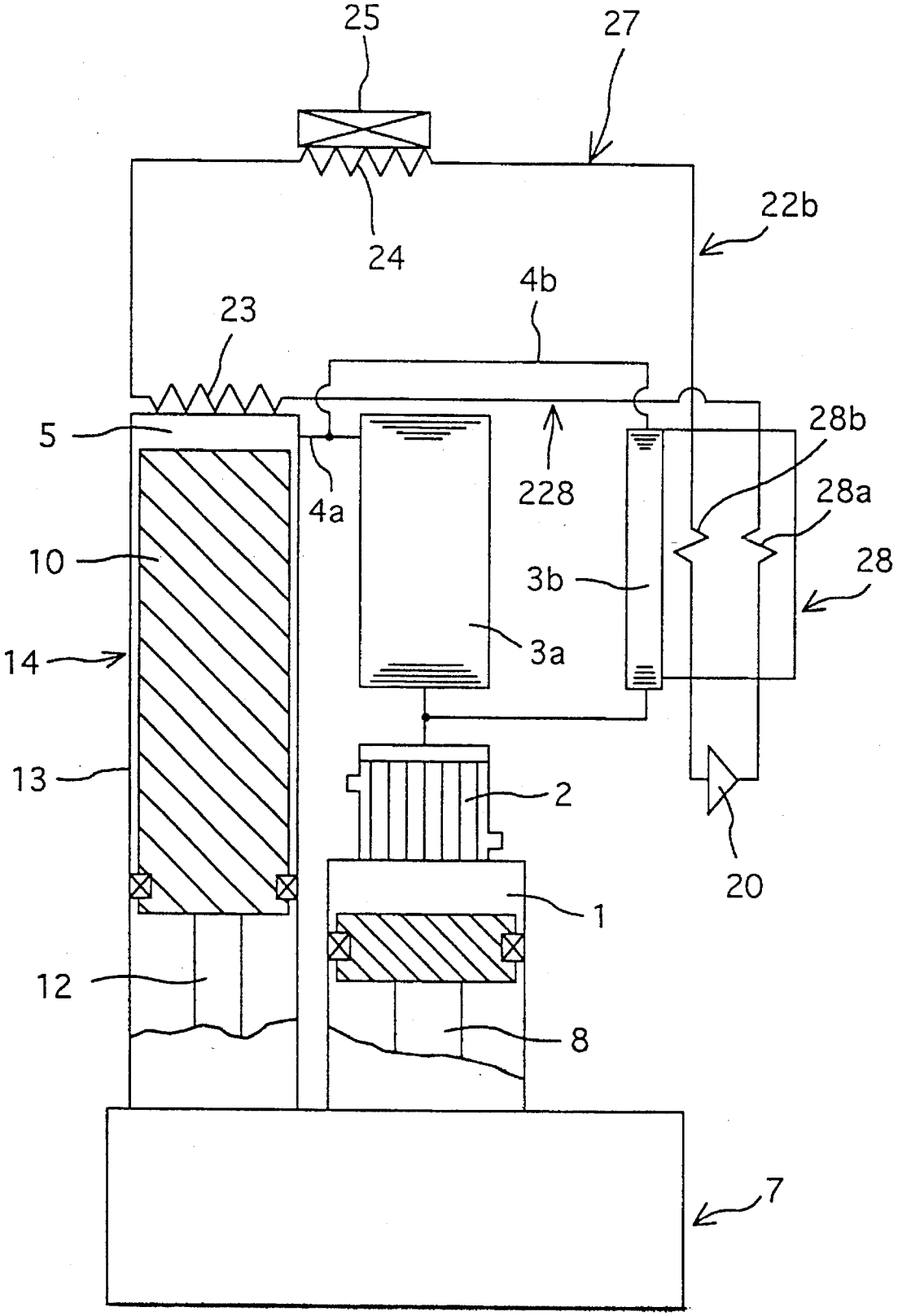
FIG. 13 is a conceptional diagram of a Ninth Preferred Embodiment of a cooling system according to the present invention.

FIG. 13 illustrates the Ninth Preferred Embodiment which is a modified version of the Eighth Preferred Embodiment illustrated in FIG. 12. Specifically, a cold accumulator 3*b* is thermally brought into contact with a low-pressure-side heat-exchanging passage 28*b* of a counterflow heat exchanger 28.

Figure 14:
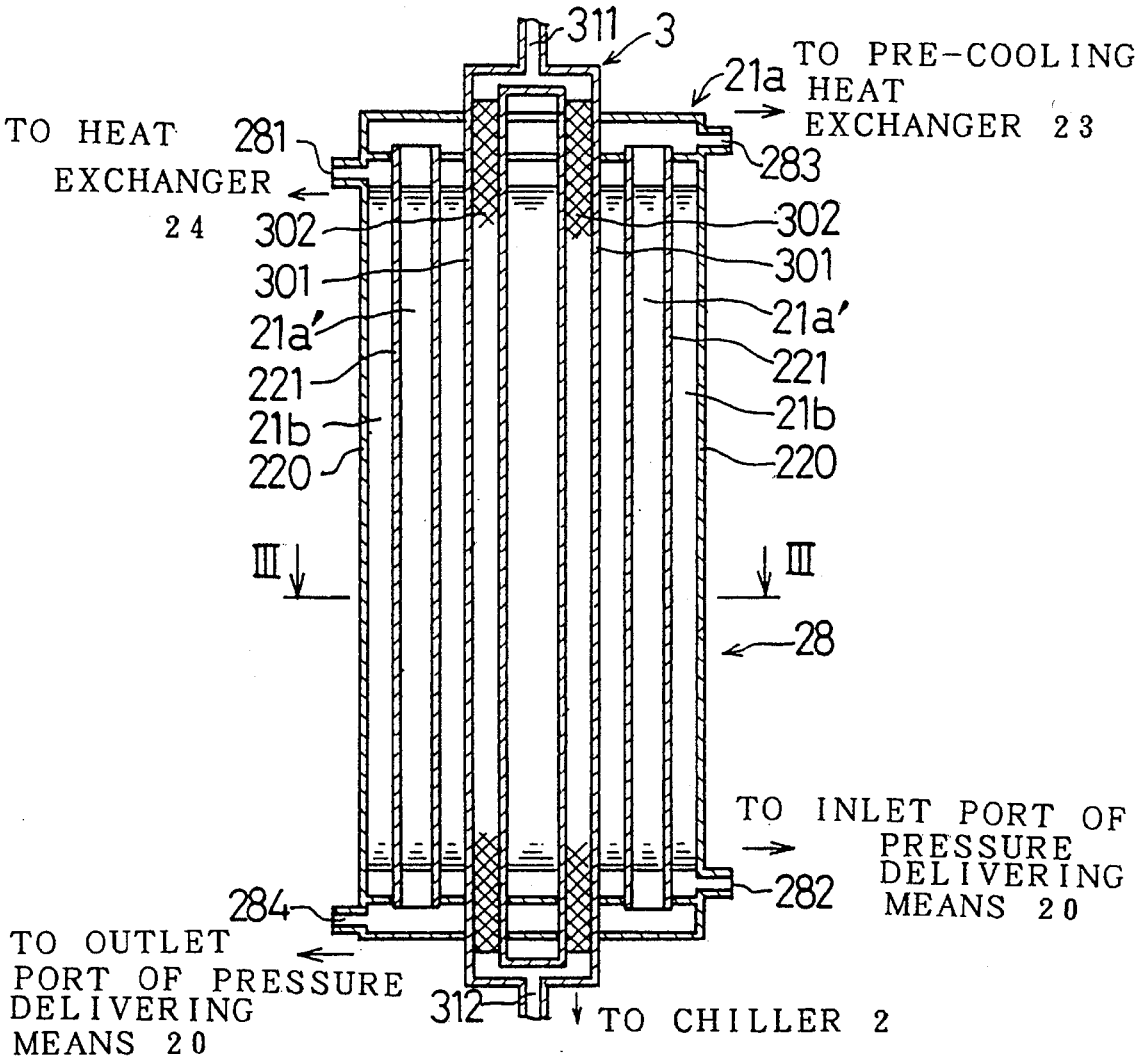
FIG. 14 is a cross-sectional view for illustrating a specific example on a thermal-contact construction between a cold accumulator and a counterflow heat exchanger which can be employed in the Ninth Preferred Embodiment.
Figure 15:
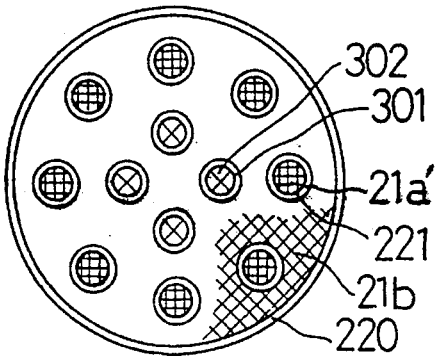
FIG. 15 is a cross-sectional view for illustrating a cross-sectional construction thereof taken along lines III—III of FIG. 14.

FIGS. 14 and 15 illustrate a specific construction in which the low-pressure-side heat-exchanging passage 28*b* of the counterflow heat exchanger 28 is thermally brought into contact with the cold accumulator 3*b*. For instance, as illustrated in FIG. 15, the counterflow heat exchanger 28 includes an outer-jacket container 220 in which a low-pressure-side heat-exchanging member 21*b'* is filled, pipes 221 in which a high-pressure-side pressure-side heat-exchanging member 21*a'* is filled and which are disposed independently in the outer-jacket container 220, and containers 301 in which a cold-accumulating member 301 is sealed and which are disposed independently in the outer-jacket container 220. Thus, a second refrigerant passing through the outer-jacket container 220 is thermally brought into contact with the cold-accumulating member 302 via the containers 301.

In the thus constructed Ninth Preferred Embodiment, the second refrigerant flowing in the low-pressure-side heat-exchanging passage 28*b* is cooled by the cold-accumulating member 302 flowing in the cold accumulator 3. This refrigeration is transmitted to the second refrigerant flowing in the high-pressure-side heat-exchanging passage 28*a*, and thereby the second refrigerant is cooled.

When the second refrigerant flowing in the low-pressure-side heat-exchanging passage 21*b* of the counterflow heat exchanger 28 is thus thermally brought into contact with the cold accumulator 3, not only the second refrigerant flowing in the low-pressure-side heat-exchanging passage 21*b* of the counterflow heat exchanger 28 is cooled by the first refrigerant flowing in the cold accumulator 3, but also the second refrigerant flowing in the high-pressure-side heat-exchanging passage 21*a* of the counterflow heat exchanger 28 is cooled by the second refrigerant flowing in the low-pressure-side heat-exchanging passage 21*b* of the counterflow heat exchanger 28. Accordingly, the second refrigerant flowing in the high-pressure-side heat-exchanging passage 21*a* of the counterflow heat exchanger 28 is also cooled by the first refrigerant flowing in the cold accumulator 3 indirectly. All in all, similarly to the Fifth Preferred Embodiment illustrated in FIG. 7, it is possible to enhance the heat-exchanging efficiency of the counterflow heat exchanger 28, and thereby it is possible to sharply improve the cooling efficiency of the thus constructed cooling system.

Tenth Preferred Embodiment

Figure 16:
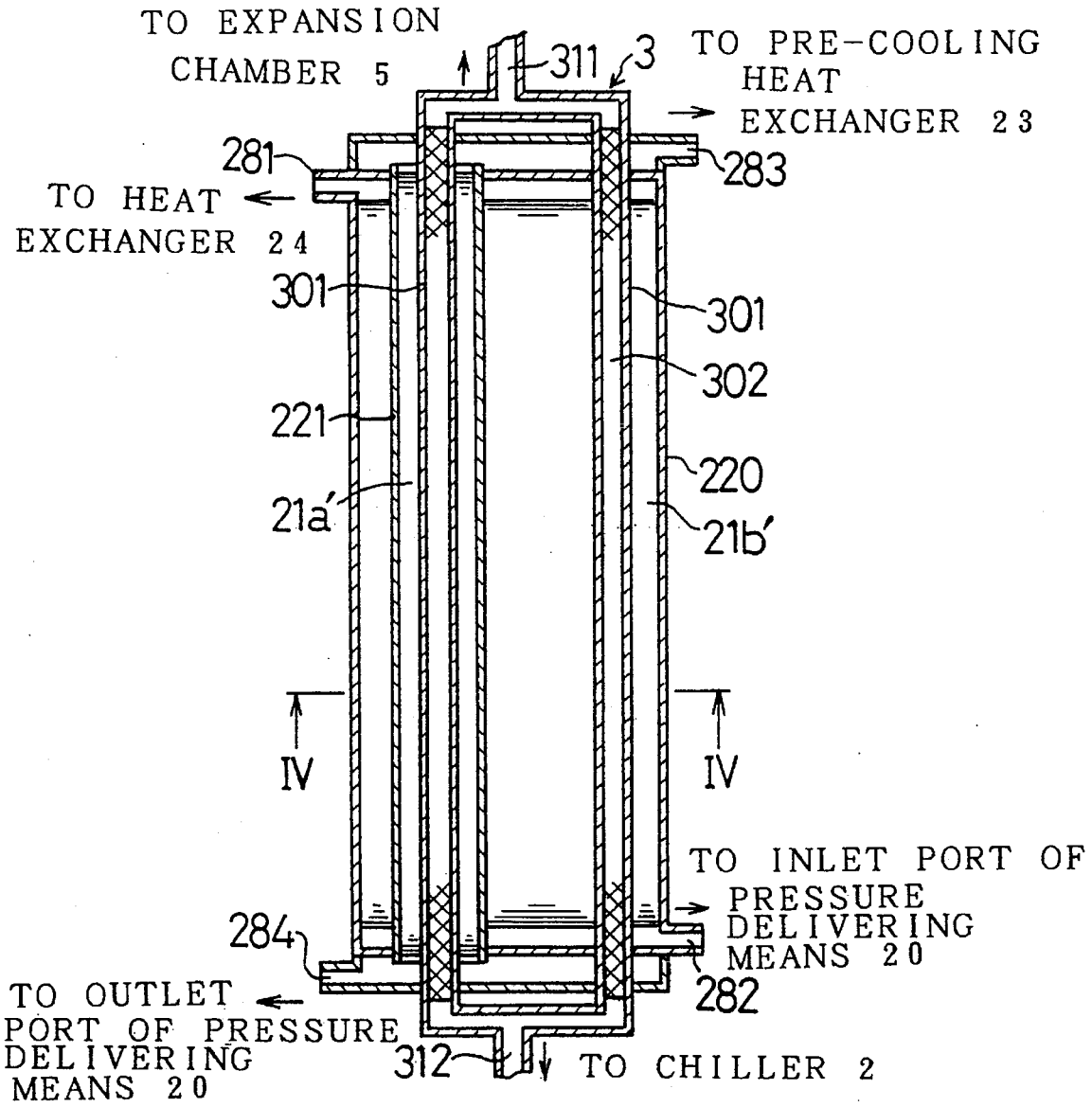
FIG. 16 is a cross-sectional view for illustrating another specific example on a thermal-contact construction between a cold accumulator and a counterflow heat exchanger in a Tenth Preferred Embodiment of a cooling system according to the present invention.
Figure 17:
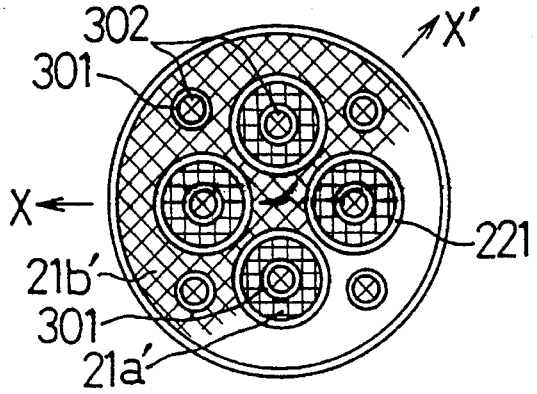
FIG. 17 is a cross-sectional view for illustrating a cross-sectional construction thereof taken along lines IV—IV of FIG. 16.

FIGS. 16 and 17 illustrate a cooling system according to a Tenth Preferred Embodiment, a modified version of the Eighth Preferred Embodiment illustrated in FIG. 12; namely: a specific construction in which a cold accumulator 3 is thermally brought into contact with a second refrigerant flowing in a high-pressure-side heat-exchanging passage 28*a* of a counterflow heat exchanger 28 as well as s low-pressure-side heat-exchanging passage 28*b* thereof. In the drawings, like reference numerals designate like component parts illustrated in FIGS. 14 and 15.

In the Tenth Preferred Embodiment, as illustrated in FIG. 17, the counterflow heat exchanger 28 includes an outer-jacket container 220 in which a low-pressure-side heat-exchanging member 21*b'* is filled, pipes 221 in which a high-pressure-side heat-exchanging member 21*a'* is filled and which are disposed in the outer-jacket container 220, and containers 301 in which a cold-accumulating member 302 is sealed. As illustrated in FIG. 16, a portion of the containers 301 is simply disposed in the outer-jacket container 220, and the other portion of the containers 301 is further disposed in the pipes 221. Thus, not only the second refrigerant flowing in the high-pressure heat-exchanging passage 28*a*, but also the second refrigerant flowing in the low-pressure-side heat-exchanging passage 28*b* are thermally brought into contact with the cold accumulator 3. As a result, the counterflow heat exchanger 28 is further enhanced in terms of heat-exchanging efficiency, and thereby the thus constructed cooling system can be furthermore improved in terms of cooling efficiency.

Eleventh Preferred Embodiment

All of the First through Tenth Preferred Embodiments are constructed so that piping is arranged coaxially or parallelly, and that a cold accumulator and a counterflow heat exchanger are thermally brought into contact with each other via the thus arranged piping. Note that, as hereinafter described with reference to a cooling system according to an Eleventh Preferred Embodiment, a specific thermal-contact construction can be embodied by a counterflow heat exchanger including plates which have a plurality of refrigerant through bores and which are laminated one after another.

Figure 18:
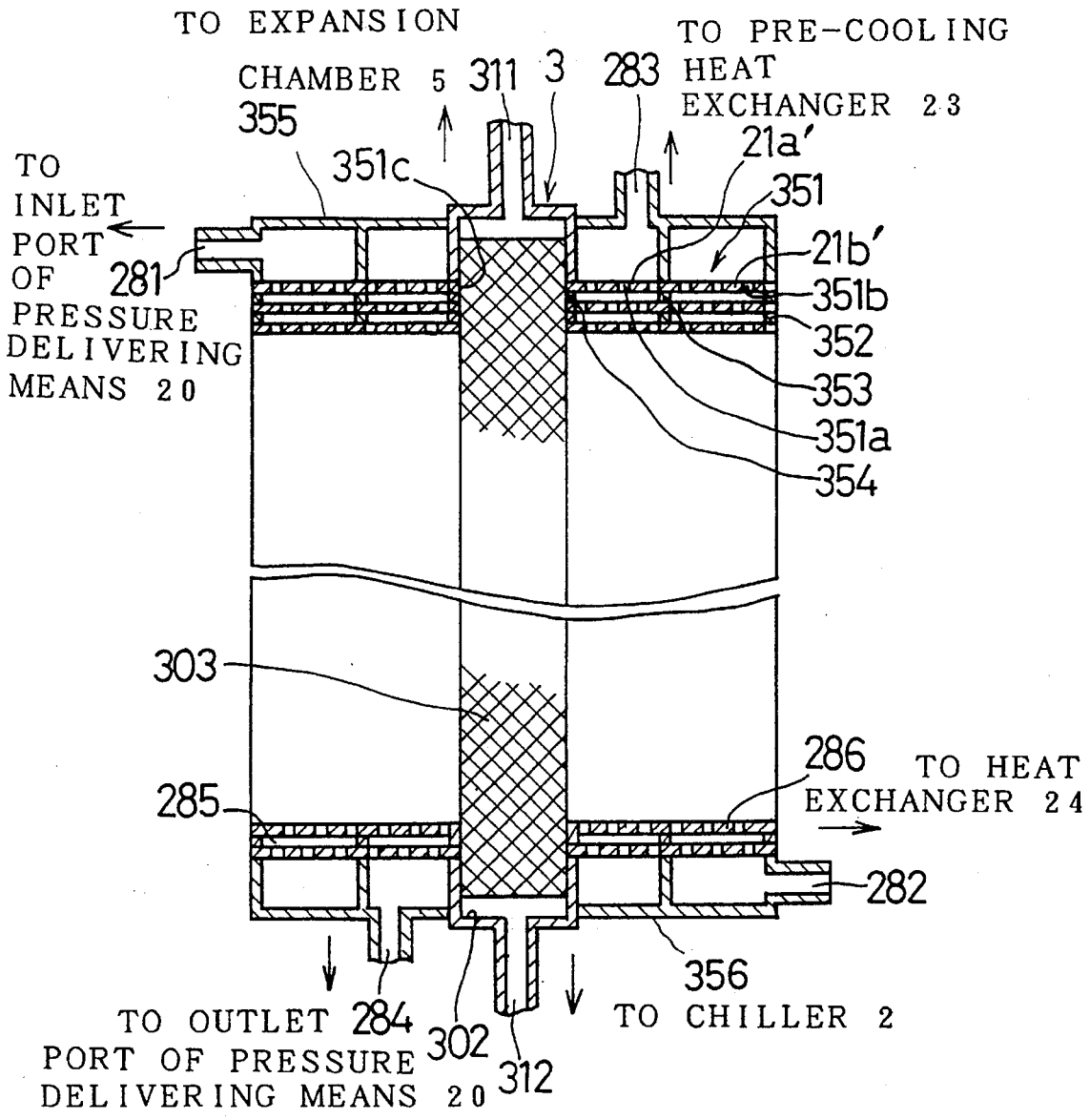
FIG. 18 is a cross-sectional view for illustrating still another specific example on a thermal-contact construction between a cold accumulator and a counterflow heat exchanger in an Eleventh Preferred Embodiment of a cooling system according to the present invention.

As illustrated in FIG. 18, at the center of a counterflow heat exchanger, there is disposed a cold accumulator 3 in which a cold-accumulating member 351*c* flows. Further, a plurality of annular plates 351 are laminated so as to coaxially surround the cold accumulator 3. In the plates 351, there are formed a plurality of minor through bores 351*a*, through which a high-pressure-side second refrigerant passes, in the inner peripheral region (i.e., on the side adjacent to the cold accumulator 3), and there are further formed a plurality of minor through bores 351b, through which a low-pressure-side second refrigerant passes, in the outer peripheral region with respect to the inner peripheral region. The plates 351 are sealed air-tight between them and the cold accumulator 3, between themselves, and between them and the outside by spacers 354, 353, 352, respectively. The spacers 354 are interposed between the cold accumulator 3 and the inner peripheral region. The spacers 353 are interposed between the inner peripheral region and the outer peripheral region. The spacers 352 define an outside contour of the counterflow heat exchanger. The free ends of the thus laminated plates 351 are held between cover members 355, 356. The cover members 355, 356 are provided with predetermined inlet ports 281, 284 and outlet ports 282, 283.

This counterflow heat exchanger thus constructed by the plates 351 and spacers 354, 353, 352 can substitute the heat exchangers employed in the above-described First through Tenth Preferred Embodiments, and constitute the cooling systems according to these preferred embodiments.

Twelfth Preferred Embodiment

Figure 19:
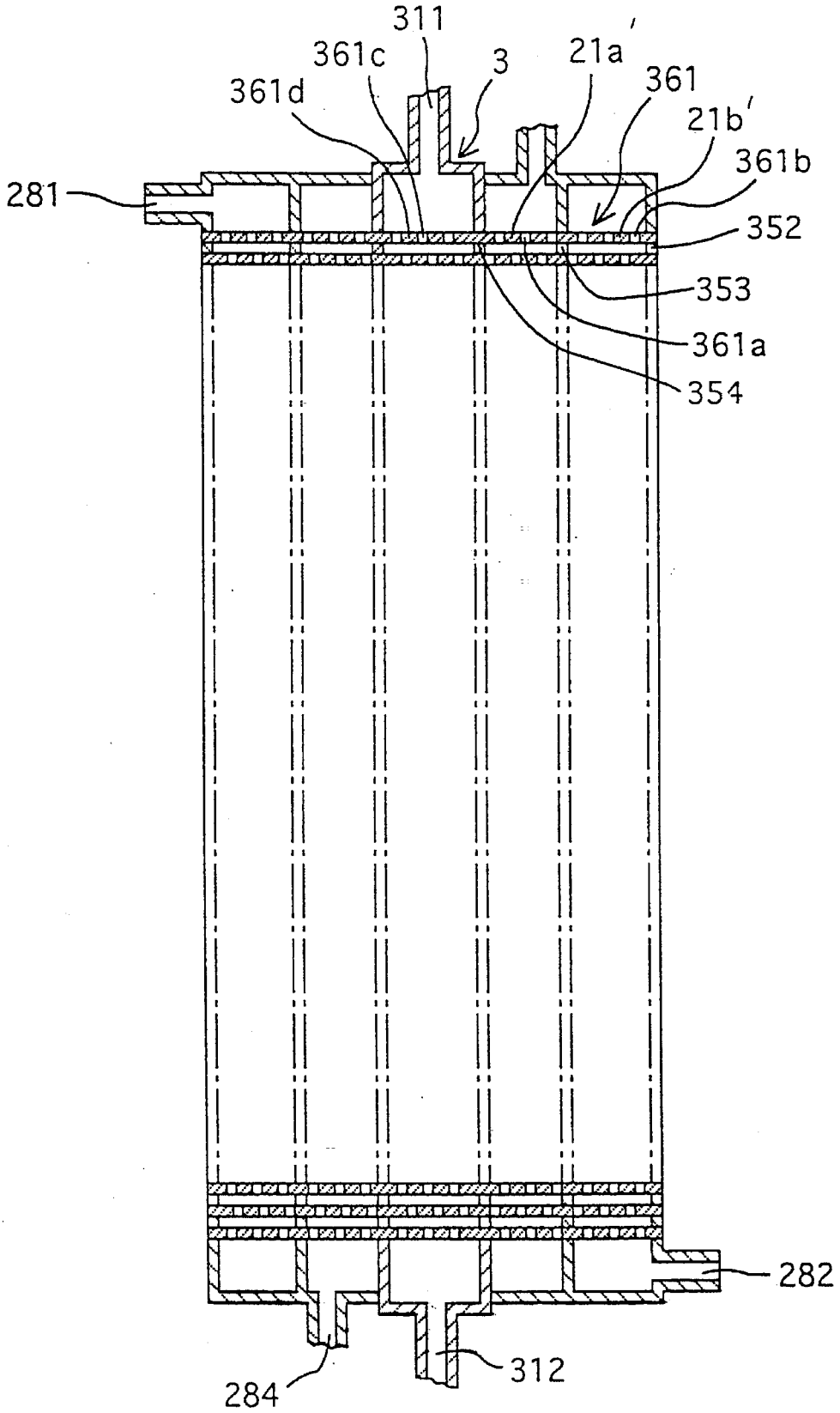
FIG. 19 is a cross-sectional view for illustrating a further specific example on a thermal-contact construction between a cold accumulator and a counterflow heat exchanger in a Twelfth Preferred Embodiment of a cooling system according to the present invention.

As illustrated in FIG. 19, in a cooling system according to a Twelfth Preferred Embodiment, a cold accumulator 3 is further constituted by a plurality of spacers 361 laminated together. The spacers 361 are formed as a disk. At the central region of the spacers 361, there are formed a large number of minor through bores 361*c*, through which a cold-accumulating member flows. At the intermediate peripheral region outside with respect to the minor through bores 361*c*, there are formed a plurality of minor through bores 361*a*, through which a high-pressure-side second refrigerant passes. At the outermost peripheral region outside with respect to the intermediate outer peripheral region, there are formed a plurality of minor through bores 361*b*, through which a low-pressure-side second refrigerant passes.

The thus constructed cold accumulator 3 can substitute the cold accumulators employed in the above-described First through Tenth Preferred Embodiments, and constitute the cooling systems according to these preferred embodiments.

Figure 20:
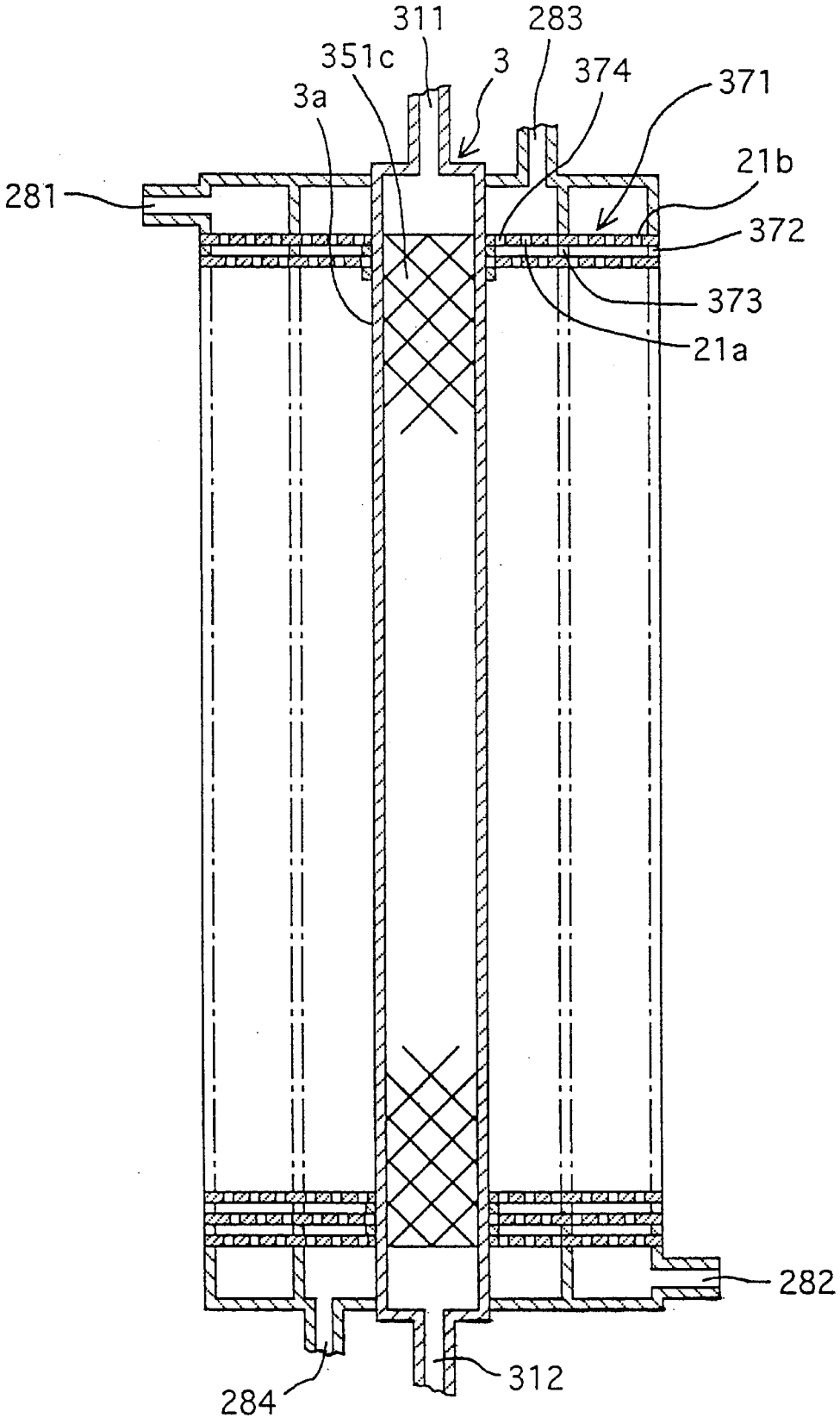
FIG. 20 is a cross-sectional view for illustrating a furthermore specific example on a thermal-contact construction between a cold accumulator and a counterflow heat exchanger in a modified version of the Twelfth Preferred Embodiment.
Figure 21:
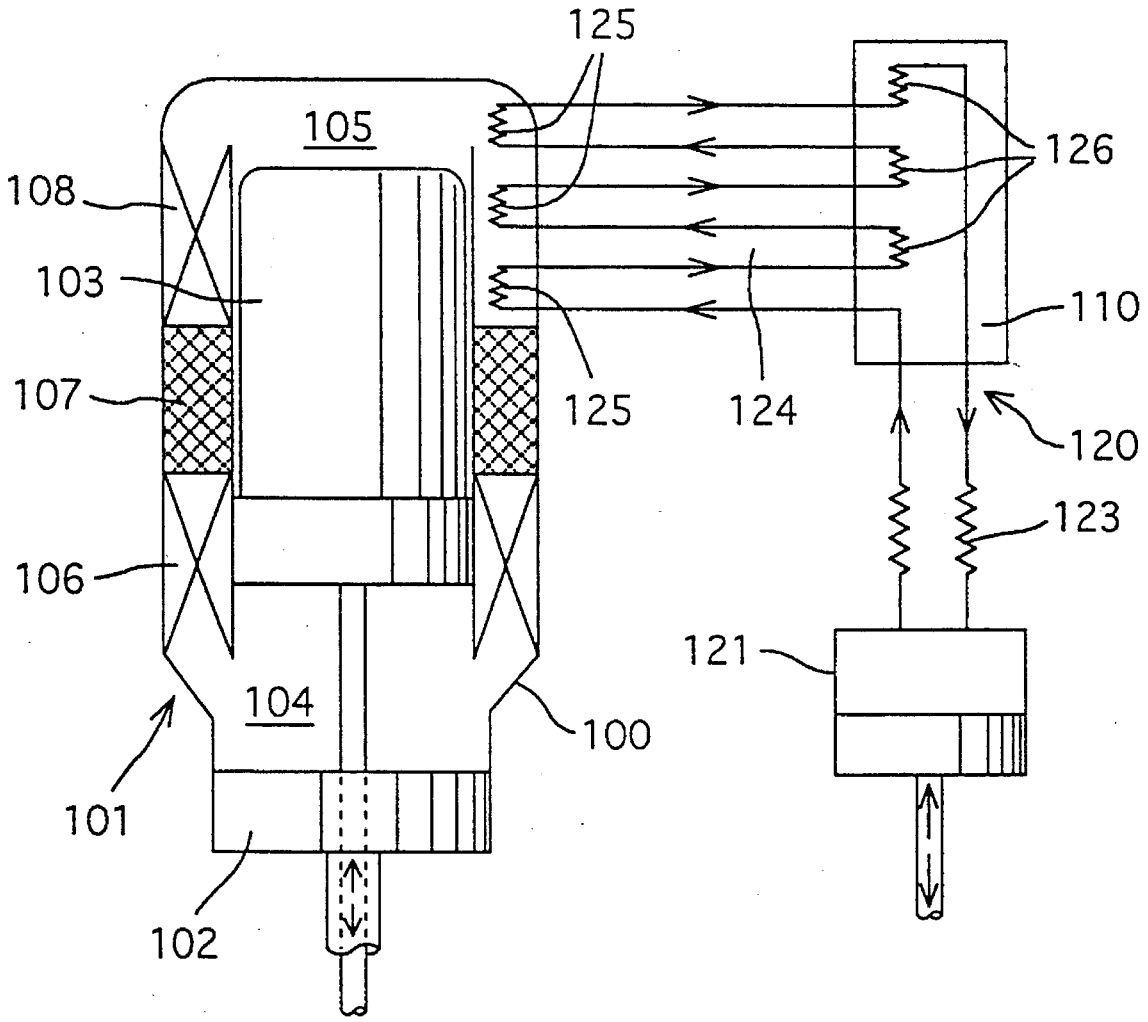
FIG. 21 is a diagram for illustrating a cooling system in which a conventional cold-accumulating refrigerator is employed.

In particular, as illustrated in FIG. 20, it is further preferred that the thus constructed cold accumulator further includes a cylindrical container 3a which covers a cold-accumulating member 351*c* flowing through the central portion.

Having now fully described the present invention, it will be apparent to one of ordinary skill in the art that many changes and modifications can be made thereto without departing from the spirit or scope of the present invention as set forth herein including the appended claims.

What is claimed is:

1. A cooling system, comprising:

a cold-accumulating refrigerator including:

a compression chamber in which a working medium is compressed;

a chiller for dissipating heat resulting from the compression of the working medium;

a cold accumulator communicating with the chiller; and an expansion chamber in which the working medium, transferred via the cold accumulator, is expanded; and a cooling circuit including:

a heat exchanger for conducting cold, the heat exchanger being thermally brought into contact with a portion of the cold accumulator whose temperature is varied from a high temperature to a low temperature by the working medium flowing therein; and pressure delivering means for delivering cold produced by the heat exchanger to a substance to be cooled.

2. The cooling system according to claim 1, wherein the heat exchanger is disposed in said cold accumulator.

3. The cooling system according to claim 1, wherein the expansion space includes a peripheral wall defining a cylinder outer periphery; and the heat exchanger and the cold accumulator are disposed coaxially with the cylinder outer periphery.

4. The cooling system according to claim 1, wherein said cooling circuit further includes a second heat exchanger for conducting cold, the second heat exchanger being thermally brought into contact with a low temperature end of the expansion chamber.

5. The cooling system according to claim 4, wherein said cooling circuit further includes a third heat exchanger for conducting cold, the third heat exchanger being thermally brought into contact with a low temperature end of the cold accumulator.

6. The cooling system according to claim 1, wherein the cold accumulator includes an internal passage formed therein, the internal passage constituting the heat exchanger for conducting cold produced in said cooling circuit, thereby achieving the thermal contact between the cold accumulator and the heat exchanger.

7. A cooling system, comprising:

a cold-accumulating refrigerator including:

a compression chamber in which a working medium is compressed;

a chiller for dissipating heat resulting from the compression of the working medium;

a cold accumulator communicating with the chiller; and an expansion chamber in which the working medium, transferred via the cold accumulator, is expanded; and a cooling circuit including:

a first heat exchanger for conducting cold, the first heat exchanger being thermally brought into contact with a portion of the cold accumulator whose temperature is varied from a high temperature to a low temperature by the working medium flowing therein; and a second heat exchanger for conducting cold, the second heat exchanger being thermally brought into contact with a low temperature end of at least one of the expansion chamber and the cold accumulator; and pressure delivering means for delivering cold produced by the first heat exchanger and the second heat exchanger to a substance to be cooled.

8. The cooling system according to claim 7, wherein the first heat exchanger is disposed in the cold accumulator.

9. The cooling system according to claim 7, wherein the expansion chamber includes a peripheral wall defining a cylinder outer periphery; and the first heat exchanger and the cold accumulator are disposed coaxially with the cylinder outer periphery.

10. The cooling system according to claim 7, wherein the cold accumulator includes an internal passage formed therein, the internal passage constituting the first heat exchanger for conducting cold produced in said cooling circuit, thereby achieving the thermal contact between the cold accumulator and the first heat exchanger.

11. A cooling system, comprising:

a cold-accumulating refrigerator including:

a compression chamber in which a first refrigerant is compressed;

a chiller for dissipating heat resulting from the compression of the first refrigerant;

a cold accumulator communicating with the chiller; and an expansion chamber in which the first refrigerant, transferred via the cold accumulator, is expanded; and a cooling circuit in which a second refrigerant flows, the cooling circuit including:

pressure delivering means having an inlet port and outlet port;

cooling means for cooling a substance to be cooled;

a high-pressure-side circuit connecting the outlet port of the pressure delivering means and the cooling means;

a low-pressure-side circuit connecting the cooling means and the inlet port of the pressure delivering means; and a counterflow heat exchanger for thermally bringing the second refrigerant, flowing in the high-pressure-side circuit, into contact with the second refrigerant, flowing in the low-pressure-side circuit;

at least one of the high-pressure-side circuit and the low-pressure-side circuit being thermally brought into contact with a portion of the cold accumulator of said cold-accumulating refrigerator whose temperature is varied from a high temperature to a low temperature by the first refrigerant flowing therein.

12. A cooling system, comprising:

a cold-accumulating refrigerator including:

a compression chamber in which a first refrigerant is compressed;

a chiller for dissipating heat resulting from the compression of the first refrigerant;

a cold accumulator communicating with the chiller; and an expansion chamber in which the first refrigerant, transferred via the cold accumulator, is expanded; and a cooling circuit in which a second refrigerant flows, the cooling circuit including:

pressure delivering means having an inlet port and outlet port;

cooling means for cooling a substance to be cooled;

a high-pressure-side circuit connecting the outlet port of the pressure delivering means and the cooling means;

a low-pressure-side circuit connecting the cooling means and the inlet port of the pressure delivering means; and a first counterflow heat exchanger for thermally bringing the second refrigerant, flowing in the high-pressure-side circuit, into contact with the second refrigerant, flowing in the low-pressure-side circuit;

at least one of the high-pressure-side circuit and the low-pressure-side circuit being thermally brought into contact with a portion of the cold accumulator of said cold-accumulating refrigerator whose temperature is varied from a high temperature to a low temperature by the first refrigerant flowing therein;

a second counterflow heat exchanger for thermally bringing the second refrigerant, flowing in the high-pressure-side circuit downstream with respect to the first counterflow heat exchanger, into contact with the second refrigerant, flowing in the low-pressure-side circuit upstream with respect to the first counterflow heat exchanger; and a Joule-Thomson valve disposed between the second counterflow heat exchanger and the cooling means in the high-pressure-side circuit.

13. The cooling system according to claim 11 or 12, wherein said cooling circuit further includes a heat exchanger for conducting cold, the heat exchanger being thermally brought into contact with a low temperature end of the expansion chamber.

14. The cooling system according to claim 11 or 12, wherein said counterflow heat exchanger includes a plurality of annular plates laminated one after another; and the annular plates include:

a central through bore for holding the cold accumulator therein, the central through bore being disposed in a central region of the annular plates;

a plurality of first minor through bores for flowing the second refrigerant, flowing in one of the high-pressure-side circuit and the low-pressure-side circuit, therethrough, the first minor through bores being disposed in an intermediate region of the annular plates outside the central region; and a plurality of second minor through bores for flowing the second refrigerant, flowing in the other one of the high-pressure-side circuit and the low-pressure-side circuit, therethrough, the second minor through bores disposed in an outermost region of the annular plates outside the intermediate region.

15. The cooling system according to claim 11 or 12, wherein said cold accumulator includes a plurality of disks laminated one after another; and the disks include:

a plurality of central minor bores for flowing the first refrigerant therethrough, the central minor bores being disposed in a central region of the disks;

a plurality of first minor through bores. for flowing the second refrigerant, flowing in one of the high-pressure-side circuit and the low-pressure-side circuit, therethrough, the first minor through bores being disposed in an intermediate region of the disks outside the central region; and a plurality of second minor through bores for flowing the second refrigerant, flowing in the other one of the high-pressure-side circuit and the low-pressure-side circuit, therethrough, the second minor through bores disposed in an outermost region of the disks outside the intermediate region.

16. A cooling system, comprising:

a cold-accumulating refrigerator including:

a compression chamber in which a first refrigerant is compressed;

a chiller for dissipating heat resulting from the compression of the first refrigerant;

a plurality of cold accumulators respectively communicating with the chiller; and an expansion chamber in which the first refrigerant, transferred via the cold accumulators, is expanded; and a cooling circuit in which a second refrigerant flows, the cooling circuit including:

pressure delivering means having an inlet port and outlet port;

cooling means for cooling a substance to be cooled;

a high-pressure-side circuit connecting the outlet port of the pressure delivering means and the cooling means;

a low-pressure-side circuit connecting the cooling means and the inlet port of the pressure delivering means; and a heat exchanger for thermally bringing the second refrigerant, flowing in the high-pressure-side circuit, into contact with the second refrigerant, flowing in the low-pressure-side circuit;

at least one of the high-pressure-side circuit and the low-pressure-side circuit being thermally brought into contact with a portion of the cold accumulators of said cold-accumulating refrigerator whose temperature is varied from a high temperature to a low temperature by the first refrigerant flowing therein, at least one of the cold accumulators being free from the thermal contact.

17. The cooling system according to claim 16, wherein said cooling circuit further includes a second heat exchanger for conducting cold, the second heat exchanger being thermally brought into contact with a low temperature end of the expansion chamber.

* * * * *